US008662422B2

(12) United States Patent
Ward et al.

(10) Patent No.: US 8,662,422 B2
(45) Date of Patent: Mar. 4, 2014

(54) APPARATUS FOR TREATMENT OF SNOW AND ICE

(75) Inventors: Mart E. Ward, Manchester, IA (US); Randall L. Smedstad, Cedar Rapids, IA (US); Marc E. Cabalka, Independence, IA (US); Scott G. Lueken, Worthington, IA (US); Glenn L. Ungerer, Swisher, IA (US)

(73) Assignees: Henderson Enterprises, Inc., Manchester, IA (US); Henderson Products, Inc., Manchester, IA (US)

( * ) Notice: Subject to any disclaimer, the term of this patent is extended or adjusted under 35 U.S.C. 154(b) by 926 days.

(21) Appl. No.: 12/061,387

(22) Filed: Apr. 2, 2008

(65) Prior Publication Data

US 2008/0203187 A1 Aug. 28, 2008

Related U.S. Application Data

(63) Continuation of application No. 10/658,151, filed on Sep. 9, 2003, now Pat. No. 7,370,818.

(60) Provisional application No. 60/409,169, filed on Sep. 9, 2002.

(51) Int. Cl.

| | |
|---|---|
| ***B05B 17/00*** | (2006.01) |
| ***B05B 7/00*** | (2006.01) |
| ***E01C 19/20*** | (2006.01) |
| ***A01C 19/00*** | (2006.01) |
| ***B60P 3/24*** | (2006.01) |
| ***B60P 3/22*** | (2006.01) |

(52) U.S. Cl.
USPC ..... 239/662; 239/146; 239/162; 239/675; 239/687; 280/833; 280/838

(58) Field of Classification Search
USPC ..... 239/61, 62, 67, 69, 146, 159–164, 166, 239/167, 172, 176, 650, 657, 662, 664–666, 239/672, 677, 681, 687; 280/833, 837–839; 700/283
See application file for complete search history.

(56) References Cited

U.S. PATENT DOCUMENTS 2,533,772 A * 12/1950 De Frees ..... 280/4
3,401,890 A 9/1968 Middlesworth (Continued)

OTHER PUBLICATIONS

Photograph of combination granular/anti-icing units, Monroe Truck Equipment of Monroe, WI, available prior to Sep. 9, 2003.

(Continued)

*Primary Examiner* — Darren W Gorman
(74) *Attorney, Agent, or Firm* — Leydig, Voit & Mayer, Ltd.

(57) ABSTRACT

A vehicle is disclosed which includes a chassis and a storage and dispensing apparatus. The storage and dispensing apparatus can be mounted directly to the chassis or disposed within or on a body, which in turn is mounted to the chassis. The storage and dispensing apparatus has an opening therein to permit material to be transported therethrough. A conveyor assembly for selectively conveying materials from the opening of the storage and dispensing apparatus is also included. The conveyor assembly can include a dual auger arrangement. The vehicle includes a spreader chute that is operably arranged with the conveyor assembly to direct the materials to a spreader. A liquid storage system for storing liquid is provided. A liquid dispensing system is provided for selectively dispensing liquid from the liquid storage system. The liquid dispensing system includes an anti-icing system for selectively dispensing liquid from the vehicle and a pre-wetting system for selectively dispensing liquid onto material being transported by the endless conveyor out of the vehicle.

20 Claims, 18 Drawing Sheets

(56) References Cited

U.S. PATENT DOCUMENTS

| | | | |
|---|---|---|---|
| 4,230,280 | A | 10/1980 | Leigh et al. |
| 4,315,602 | A | 2/1982 | Kubacak et al. |
| 4,442,979 | A | 4/1984 | Kupper |
| 5,186,396 | A | 2/1993 | Wise et al. |
| 5,318,226 | A | 6/1994 | Kime et al. |
| 5,501,403 | A | 3/1996 | van Vooren |
| 5,772,389 | A | 6/1998 | Feller |
| 5,904,296 | A | 5/1999 | Doherty et al. |
| 5,931,393 | A | 8/1999 | Alsip et al. |
| 5,988,535 | A | 11/1999 | Kime |
| 6,068,200 | A | 5/2000 | Kime |
| 6,123,276 | A | 9/2000 | Ungerer et al. |
| 6,173,904 | B1 | 1/2001 | Doherty et al. |
| 6,179,230 | B1 | 1/2001 | Geroux et al. |
| 6,220,532 | B1 | 4/2001 | Manon et al. |
| 6,308,900 | B2 | 10/2001 | Geroux et al. |
| 6,354,786 | B1 | 3/2002 | Feller |
| 6,394,735 | B2 | 5/2002 | Hollinrake et al. |
| 6,446,879 | B1 | 9/2002 | Kime |
| 6,585,472 | B2 | 7/2003 | Hollinrake et al. |
| 6,761,525 | B2 | 7/2004 | Hollinrake et al. |
| 6,786,435 | B2 | 9/2004 | Mishra |
| 6,945,482 | B2 | 9/2005 | Hollinrake et al. |

OTHER PUBLICATIONS 2 photographs of combination sander/anti-ice unit (City/county of Denver, CO), Monroe Truck Equipment of Monroe, WI, avaliable prior to Sep. 9, 2003.

* cited by examiner

APPARATUS FOR TREATMENT OF SNOW AND ICE

CROSS-REFERENCE TO RELATED PATENT APPLICATIONS

This patent application is a continuation of application Ser. No. 10/658,151, filed Sep. 9, 2003, now U.S. Patent. No. 7,370,818, and entitled "Apparatus For Treatment Of Snow. And Ice," which claims the benefit of priority to U.S. Provisional Application No. 60/409,169, filed Sep. 9, 2002, the entire contents of which are hereby incorporated by reference in their entireties.

FIELD OF THE INVENTION

The present invention relates generally to a vehicle for treatment of snow and/or ice on a surface such as a roadway.

BACKGROUND OF THE INVENTION

The treatment of snow and ice covered roadways has included devices for the pre-treatment and treatment of road surfaces in connection with the accumulation of snow or ice thereon. Response time is especially important as winter storm conditions can change quickly. The process of pre-treating roadways, also referred to as "anti-icing," with liquid solutions before the arrival of freezing rain or snow has served to improve road surface conditions during the early stages of a storm. Once the temperature drops or heavy snowfall occurs, however, the more conventional process of spreading granular materials, such as, salt and/or sand, for example, also referred to as "de-icing," is typically relied upon to maintain road surfaces for driving.

Conventional methods for treating snow and ice covered roadways employ the use of separate application equipment to dispense granular materials, such as salt/sand spreaders, or bulk liquid spray systems, such as skid mounted tank/sprayer systems or bulk storage tanker/trailer rigs fitted with spray booms. A conventional method for delivering both granular and liquid materials include the combination of a V-box spreader and a pre-wet system of liquid storage tanks mounted typically in a dump body or on the flatbed of a truck.

While existing systems for treating snow and ice-covered roadways provide many desirable features and advantages, there remain certain problems with these combination bodies. For example, current methods require separate vehicles or add on trailers to transport and dispense sufficient quantities of both liquid anti-icing and granular de-icing materials. Space limitations of this combination of equipment tend to limit the volume of either one or both of the de-icing and anti-icing materials. A traditional V-box spreader with a pre-wet system has insufficient capacity to store, transport, and dispense an adequate volume of liquid for anti-icing operations without sacrificing the volume of granular materials for de-icing carried on the truck. Therefore, frequent return trips to the servicing facility are required to reload depleted materials or change out equipment.

This method results in delayed or prolonged road treatment, added fuel and operator costs, and multiple pieces of equipment. For example, the conventional systems can also require an additional cost of manpower to convert the vehicles from non-ice control to granular and/or anti-icing modes. Furthermore, loss of property, or even life, can occur as a result of the delays associated with the changing of the vehicle from granular to anti-icing and back again or with operators moving from one type of truck to another.

The methods of towing trailers behind dump trucks or utilizing top heavy pre-wetting tanks attached to a spreader system can pose safety hazards for operators and travelers on the roadways.

Current methods require the use of separate or different equipment depending on air and surface temperatures, the form of precipitation, (freezing rain or snow), timing of the application (before, during or after the storm), and the method of treatment selected or best suited to the road conditions (liquid anti-icing, pre-wet granular material, or granular material only). Therefore, the need to change the equipment treating the roadways depending on the weather and/or road conditions can lead to other delays. Often, the environmental conditions better treated by anti-icing application can change in a matter of minutes to environmental conditions better treated by granular application, and vice versa.

An auger has been used to convey the materials being spread by ice control equipment, in a "tailgate spreader," for example. However, an auger typically has a much narrower effective width, i.e., the width of the auger over which it operates to convey material, than what is readily possible with a conventional chain conveyor system. The narrower effective width of the auger results in a smaller amount of material to be distributed being exposed above the top of the conveyor itself. Materials used for ice control (including cinders, sand, salt, etc.) have a tendency to bridge over the auger and therefore interrupted/disrupted material flow can result. Also, an auger can tunnel the material adjacent to the auger, thereby defining a cylindrical cavity in the material being spread.

On the other hand, chain conveyor systems are susceptible to maintenance problems during the off-season (cold weather being typically only a few months of the year in most instances). For example, the chain can be stationary and easily rust to the point of "freezing up," making it un-useable the following season or requiring considerable maintenance time to free up the chain. Wear can be great on a chain as all the links are exposed to the ice control material being spread. Furthermore, because each link of the chain moves, the chain conveyor system has a considerable number of moving parts which in turn require a corresponding amount of maintenance.

In addition, a chain conveyor system can provide spurts of flow associated with the flighting bars extending between the chains. Every bar brings a quantity of material followed by a period of time with less, or no, material flow. The uneven discharge flow can cause "striping" of ice control materials on the pavement and also can require the spreading of materials in amounts larger than needed to compensate for this interrupted flow characteristic.

In view of the foregoing, there exist various needs in the art. One such need is for an apparatus which provides improved capacity and integration of anti-icing and de-icing materials for winter road maintenance. Another need is for an apparatus which achieves a higher, level of efficiency and accuracy of the application.

SUMMARY OF THE INVENTION

The present invention addresses the foregoing and other needs by providing a vehicle including a chassis and a storage and dispensing apparatus having a hopper for storing granular material, a conveyor assembly for selectively discharging material stored in the hopper, a liquid storage system, and a liquid dispensing system for selectively dispensing liquid from the liquid storage system. The storage and dispensing apparatus can be mounted directly to the chassis or to a body of the vehicle, for instance.

The body can comprise front and rear ends and first and second side walls. The body can be pivotally mounted to the chassis and arranged with a hoist for pivotal movement thereof.

The storage and dispensing apparatus can be disposed within the body. The storage and dispensing apparatus can include front and rear ends, first and second side walls, and a common wall. The common wall defines a hopper for storing granular material and a liquid containment uni-body construction vessel for storing liquid. Advantageously, the common wall serves to improve the strength of the combined body while reducing weight and costs.

In one aspect of the invention, the conveyor assembly comprises a pair of augers in substantially parallel, spaced relationship to each other. The rear end of the snow and ice treatment system has an opening which communicates with the material hopper to permit material to be transported therethrough by the dual auger arrangement.

Advantageously, the dual auger system is a simple mechanical device which has fewer moving parts than a chain conveyor system. Cleaning and lubricating the dual auger system is readily accomplished. Each auger can have a single bearing at each end of the auger shaft. A direct drive motor can be provided for each auger to rotate the auger and to act as one of the bearing supports. A flange-mounted, sealed, self-aligning bearing can provide support at the other end. A sealed greasing system, either automatic or manual, for example, can be provided to extend conveyor system life and to control cost of maintenance. The sealed lubrication system contains the lubricant, thereby substantially preventing lubricant leakage from the conveyor onto the pavement which would create environmental concerns.

The dual auger system can increase the effective width of the conveying system by at least doubling the effective width compared to a single auger. By increasing the effective width, the likelihood of bridging or tunneling problems occurring is reduced.

The dual auger system can provide a substantially uniform flow throughout the discharge process, thereby allowing for fine metering of the discharge materials.

In another aspect of the invention, the conveyor assembly can include an endless chain conveyor disposed between the side walls and extending beyond the rear end of the body.

In one aspect of the present invention, the vehicle includes a liquid storage system having a liquid containment vessel for storing liquid. A liquid dispensing system is provided for selectively dispensing liquid from the liquid containment vessel. The liquid dispensing system includes an anti-icing system for selectively dispensing liquid from the vehicle and a pre-wetting system for selectively dispensing liquid onto material being transported by the endless conveyor out of the vehicle.

Advantageously, for improved handling and safety, the liquid storage system can be configured such that the center of gravity of the vehicle is relatively low compared to other prior art devices.

The sidewalls of the body can each include a plurality of vertical supports each having a plurality of openings therethrough. The vertical supports can extend through the liquid storage system. The openings allow for liquid to enter into the storage system and fill the volume therein. The vertical supports can act as baffles which can inhibit the forward and aft movement of the liquid within the storage system during vehicle acceleration and deceleration, such as, during vehicle starts and stops, for example.

In another aspect of the present invention, a vehicle is provided having a body which includes a horizontal side brace. In a further aspect of the invention, the vehicle includes a liquid storage tank for storing liquid. The liquid storage tank can include a groove for accommodating the horizontal side brace of the body. The groove of the storage tank can engage the horizontal side brace of the body. The liquid storage tank can be a part of a system can be mounted to at least one of the chassis and the body, which includes a liquid dispensing system.

In still another aspect of the invention, a vehicle includes a control system for monitoring at least one parameter and controlling a liquid dispensing system depending on the condition of the at least one parameter.

Advantageously, to further facilitate the functionality of the multipurpose body, the electronic control system is provided to monitor and/or control several sensors, drive motors, pumps and conveyors utilizing, for example, input parameters established by the equipment owner. Because of the integrated design of the ice-control body, the body can readily operate in semi-automatic mode wherein the vehicle operator dispenses granular material and/or liquid according to one or more predetermined parameters, such as, ground speed, air temperature, surface temperature, surface area to be treated, rate of precipitation, form of precipitation, speed of the vehicle, dispensing rate of the liquid, spray pattern of the liquid, the dispensing rate of the material, direction and velocity of the material, and the spread pattern of the material, for example. The control system can permit very specific control of application rates of liquid, granular material or a combination thereof (3 in 1 control) based on many variables.

Advantageously, the storage and dispensing apparatus both has improved capacity and integrates multiple functions is key at the same time whereas previous devices involve a sacrifice of liquid and/or granular materials or the need for longer and/or taller equipment which is both more expensive and less safe.

Advantageously, the vehicle can transport and dispense, either individually or in any combination, a liquid anti-icing material, a granular de-icing material, and a pre-wetted granular de-icing material as road conditions warrant. Sufficient volumes of the liquid and the granular material can be contained separately on the vehicle in quantities substantially equal to a traditional V-box sander and a bulk liquid tank.

The vehicle achieves the integration of three typically separate pieces of equipment and/or vehicles into a combined, integral system. The "three-in-one system" includes a full capacity hopper for storing granular material, a high capacity anti-icing system for dispensing liquid onto a surface, and an onboard pre-wetting system for dispensing liquid onto granular material as the granular material is being dispensed from the vehicle. This combined system maximizes the payload of each material through improved utilization of space. The added capacity therefore limits the frequency of return trips and reduces the overall cost for fuel, equipment, support personnel and operators. Also, the length of the vehicle equipped with the storage and dispensing apparatus of the present invention can be shorter than conventional systems because the need for a trailer is obviated and/or the space utilization is improved, thereby facilitating the safe operation of the present invention.

The present invention provides a complete integration of all required containment/storage devices, conveying systems, application systems and controls. The inventive vehicle simplifies the complexities of controlling individual components and systems for the operator, who must not only operate the equipment but also drive the vehicle, as well. In some instances for example, the operator can be operating a front-mounted snow plow and a side-mounted ("wing") snow plow which, combined with driving the vehicle, can require his full attention.

These and other objects and advantages, as well as additional inventive features, of the present invention will become apparent to one of ordinary skill in the art upon reading the detailed description, in conjunction with the accompanying drawings, provided herein.

DETAILED DESCRIPTION OF EMBODIMENTS OF THE INVENTION

Figure 1:
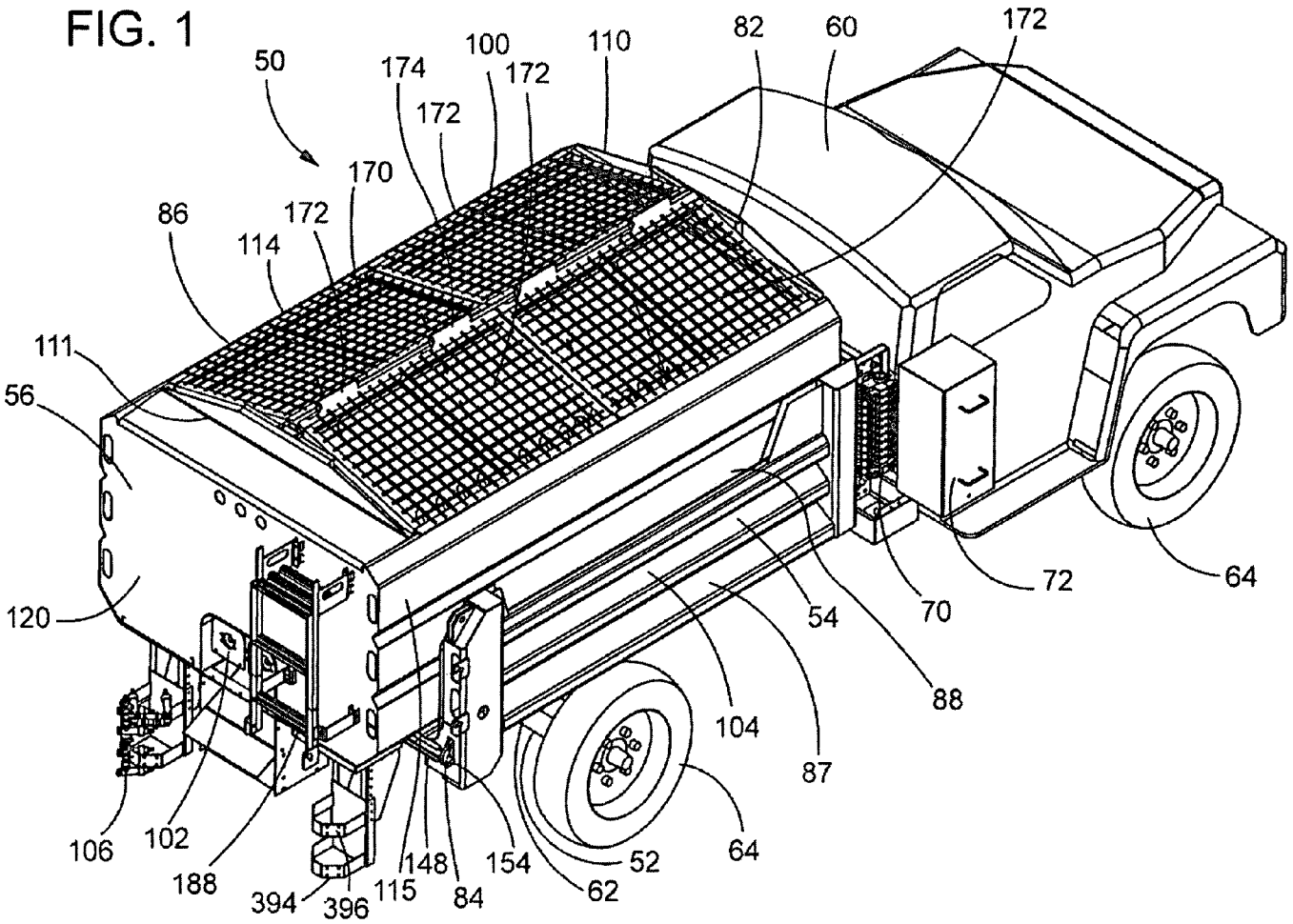
FIG. 1 is a perspective view of a vehicle including a storage and dispensing apparatus mounted in a dump body in accordance with the present invention.

Turning now to the drawings, there is shown in FIG. 1 an illustrative vehicle 50 for treatment of snow and/or ice on a surface such as a roadway in accordance with the present invention.

Referring to FIG. 1, the vehicle 50 includes a chassis 52, a dump body 54, and a removable storage and dispensing apparatus 56 disposed within the body 54.

The chassis 52 can include a truck cab 60, a frame 62, and a plurality of wheels 64. The chassis 52 includes a valve bank 70 for controlling the hydraulic system of the vehicle. A cover 72 can be provided to enclose the valve bank 70.

Figure 2:
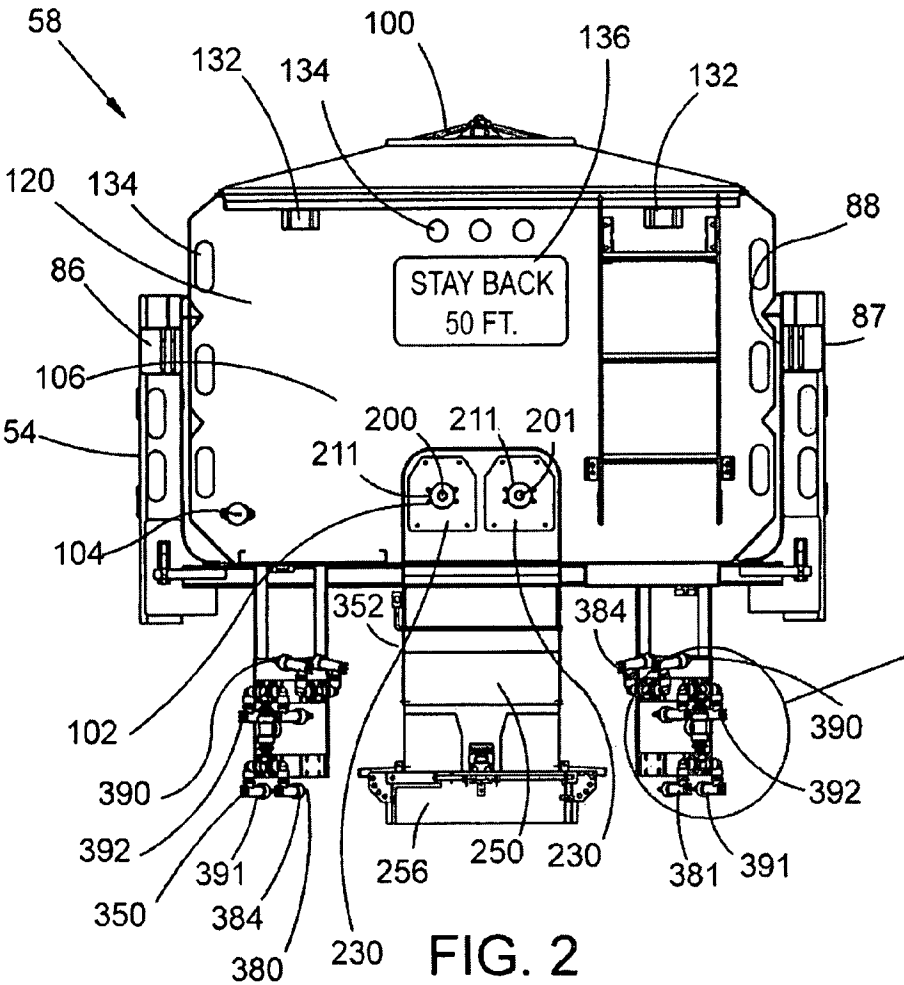
FIG. 2 is an end elevational view of the storage and dispensing apparatus and the body of FIG. 1.

The body 54 is mounted to the chassis 52. The body 54 includes a front end 82, an open rear end 84, and first and second side walls 86, 87, as shown in FIGS. 1 and 2. The body 54 is generally U-shaped, as shown in FIG. 2. The dump body 54 defines a cavity 88 for storing materials, such as gravel, dirt, brush or the like. The dump body 54 can be pivotally connected to the chassis 52 at the rear end 84 of the body 54. A hoist system can be provided to move the dump body 54 from a storing position, shown in FIG. 1, to one of a range of dumping positions. The illustrative vehicle in FIG. 1 includes an underbody hoist system. In other embodiments, the hoist can be a telescopic hoist adjacent the front end of the body.

Referring to FIGS. 1 and 2, the storage and dispensing apparatus 56 includes a hopper 100 for storing material, such as, a granular ice control material, for example, a conveyor assembly 102 for selectively transporting material from the hopper 100, a liquid storage system 104 for storing liquid, such as, an anti-icing liquid, for example, and a liquid dispensing system 106 for selectively dispensing liquid from the liquid storage system 104.

Figure 5:
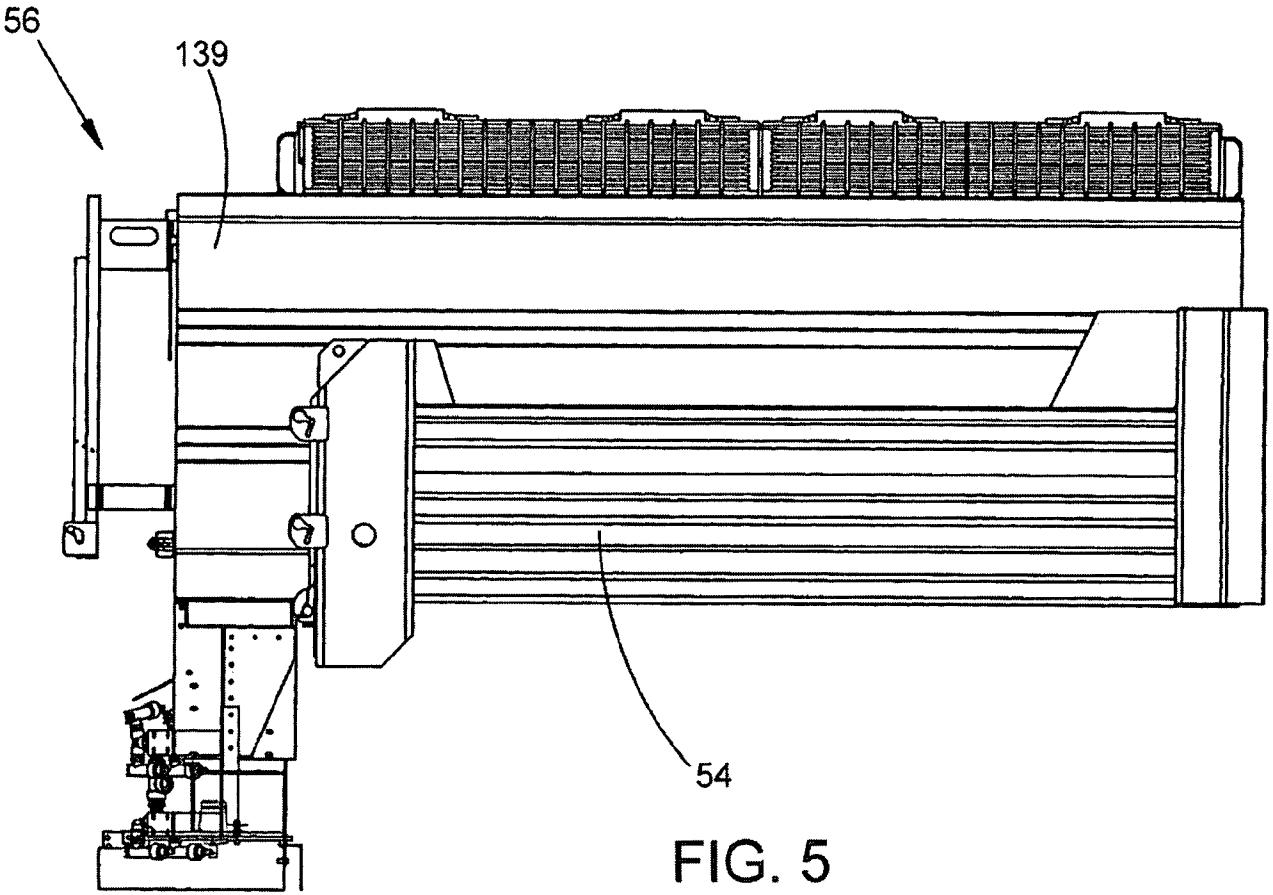
FIG. 5 is a side elevational view of the storage and dispensing apparatus and the body of FIG. 1.
Figure 6:
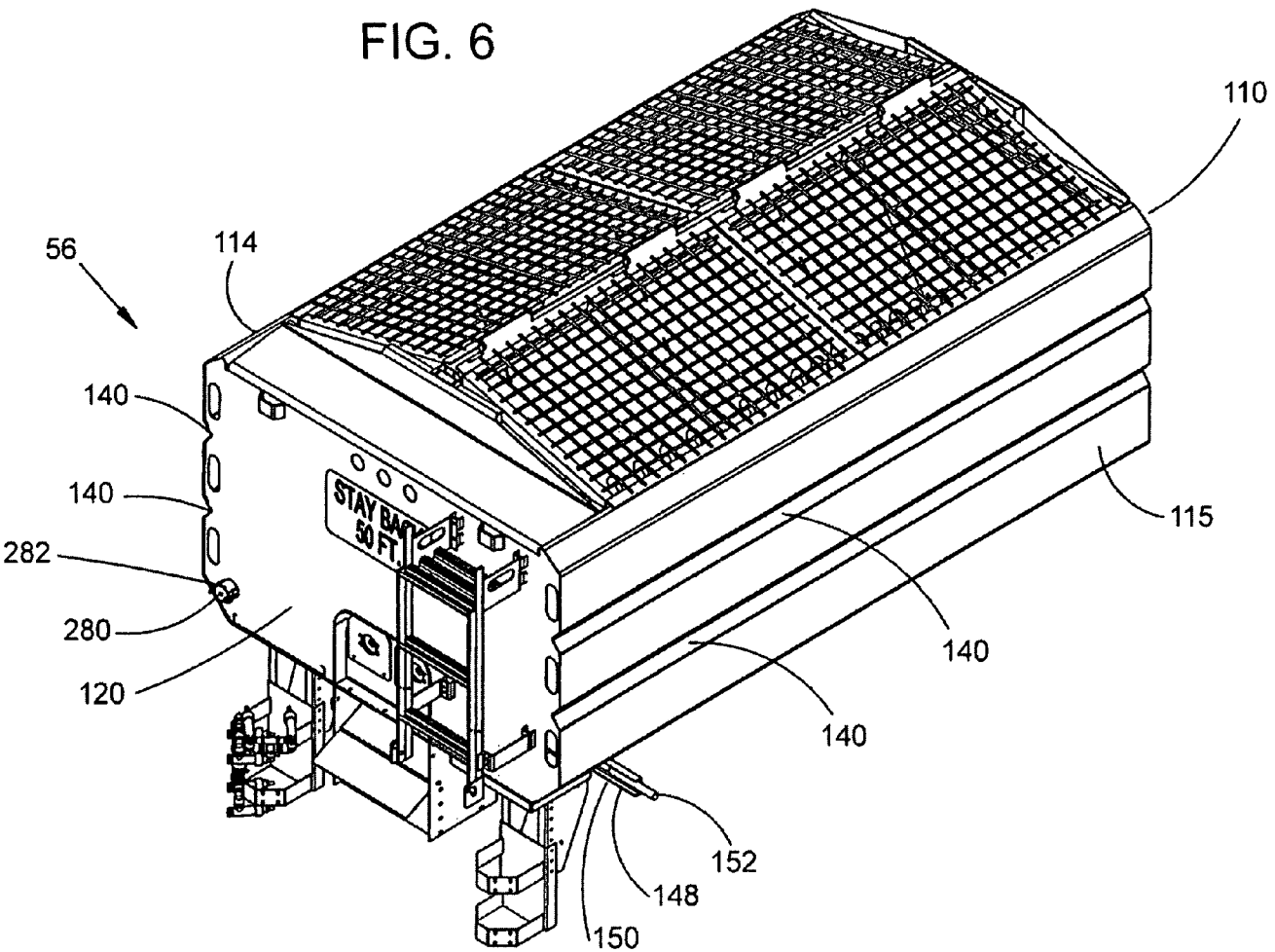
FIG. 6 is a perspective view the storage and dispensing apparatus of FIG. 1.
Figure 8:
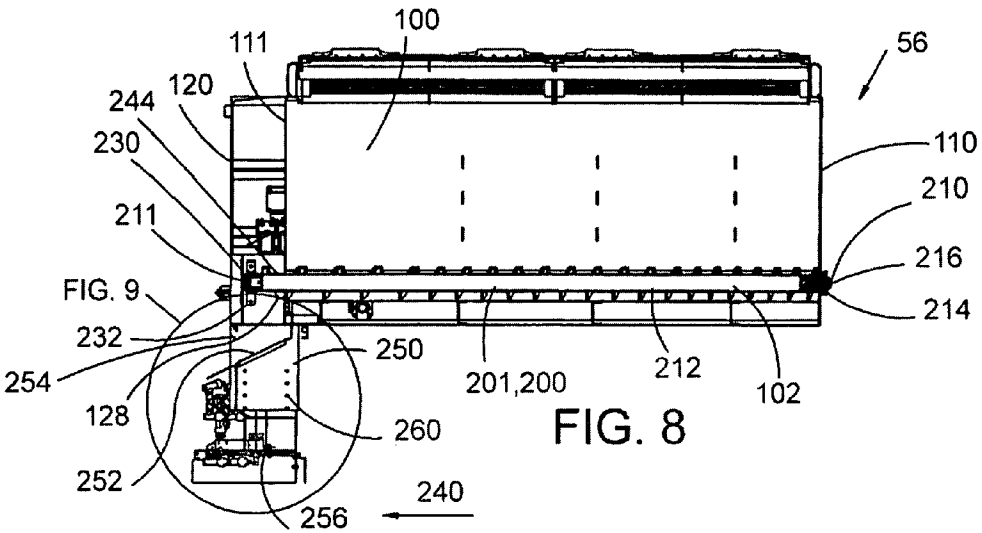
FIG. 8 is a cross-sectional view taken along line 8-8 in FIG. 7.
Figure 14:
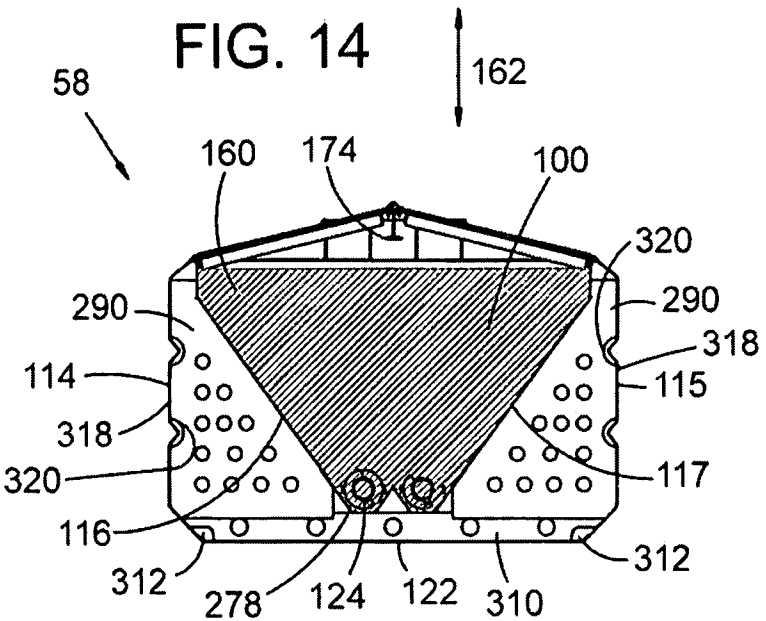
FIG. 14 is a cross-sectional view taken along line 14-14 in FIG. 13, illustrating a hopper in highlighted cross-hatching.

Referring to FIGS. 1 and 14, the storage and dispensing apparatus 56 includes front and rear ends 110, 111, first and second side walls 114, 115, first and second common walls 116, 117, a cabinet wall 120, a bottom 122, and an intermediate base 124. Referring to FIG. 8, the rear end 111 of the storage and dispensing apparatus 56 has an opening 128 therein. Referring to FIG. 2, the front and the rear ends can include a plurality of lifting eyes 132 for handling the storage and dispensing apparatus 56 with an over head crane, for example, to insert the storage and dispensing apparatus into, and remove it from, the body. The cabinet wall 120 includes a plurality of apertures 134 for mounting running lights and other indicator lights. The cabinet wall 120 can be used to display indicia 136. Referring to FIG. 5, the storage and dispensing apparatus 56 can be disposed within the body 54 with a rear portion 139 of the storage and dispensing apparatus extending therefrom. Referring to FIG. 6, the side walls 114, 115 of the storage and dispensing apparatus 56 can each include a plurality of V-crimps 140 extending between the cabinet wall 120 and the front end 110 to provide structural rigidity.

Referring to FIGS. 1 and 6, the storage and dispensing apparatus 56 can include a mounting arm 148 which includes a channel 150 and a round bar 152 extending therefrom. The mounting arm 148 of the storage and dispensing apparatus can retentively engage a pair of jaws 154 extending from the rear end 84 of the body 54 to retentively engage the storage and dispensing apparatus 56 and the body 54. The snow/ice storage and dispensing apparatus 56 can be disposed within the body 54 for use during winter months, for example, for the treatment of roadways in the event of snow and/or ice accumulation. In non-winter months, the storage and dispensing apparatus 56 can be used with other granular and liquid materials to provide dust control, vegetation control and fertilizer/seeding, for example. The storage and dispensing apparatus 56 can also be disengaged from the body 54, with the vehicle being used for other applications.

Figure 11:
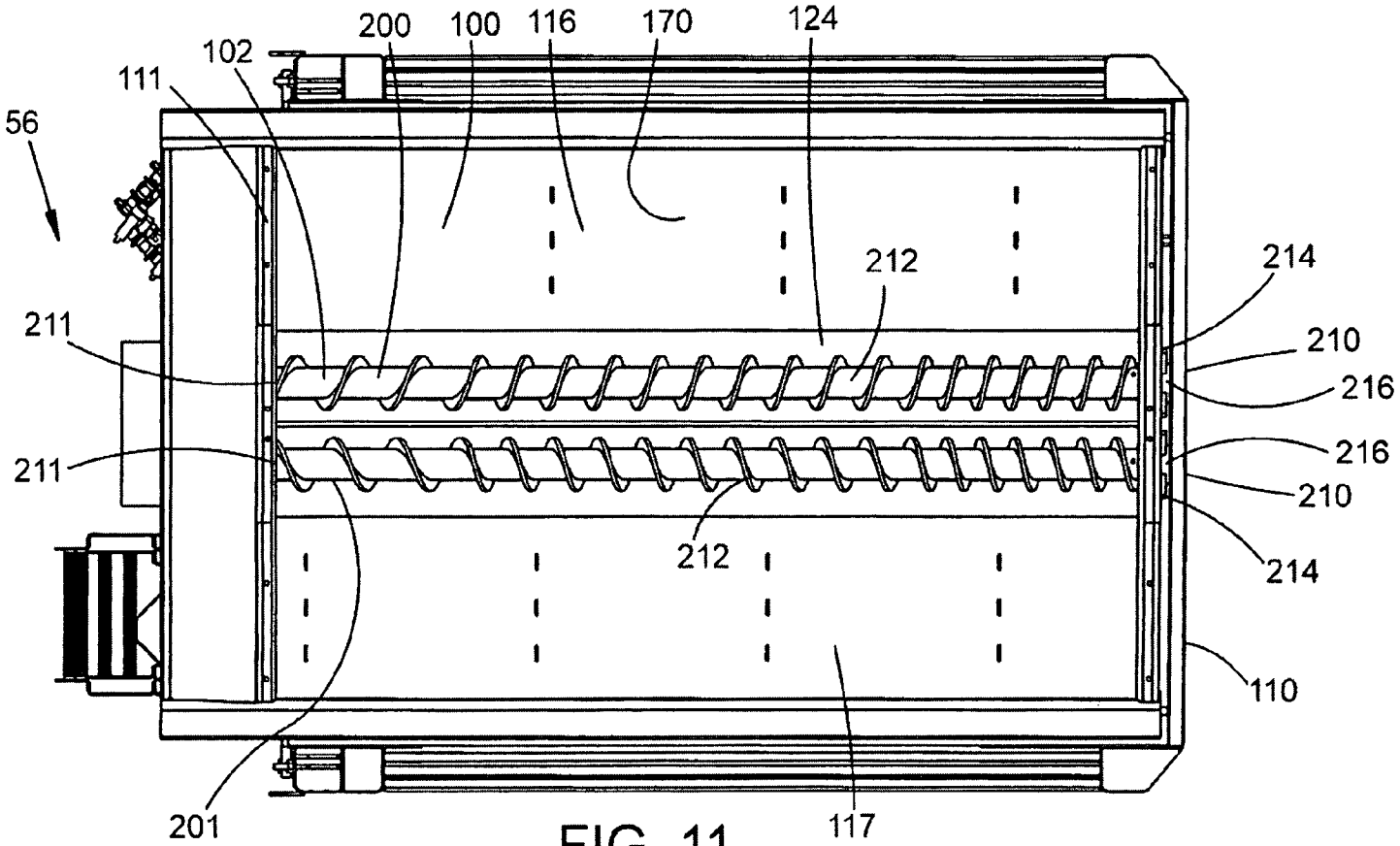
FIG. 11 is a top plan view similar to FIG. 7 with grate screens removed from the storage and dispensing apparatus for illustrative purposes.

Referring to FIGS. 11 and 14, the common walls 116, 117, the intermediate base 124, and the front and rear ends 110, 111 define the hopper 100 for storing material. The hopper 100 is shown in cross-hatching 160 in FIG. 14. The first and second common walls 116, 117 can be disposed at about a 45° to a vertical axis 162. In other embodiments, the common wall angle can vary.

Referring to FIG. 8, the opening 128 of the rear end 111 communicates with the material hopper 100. The conveyor assembly 102 is disposed in the material hopper 100 and extends through the opening 128. The conveyor assembly 102 is configured to selectively transport material from the hopper 100 out of the storage and dispensing apparatus 56.

Figure 4:
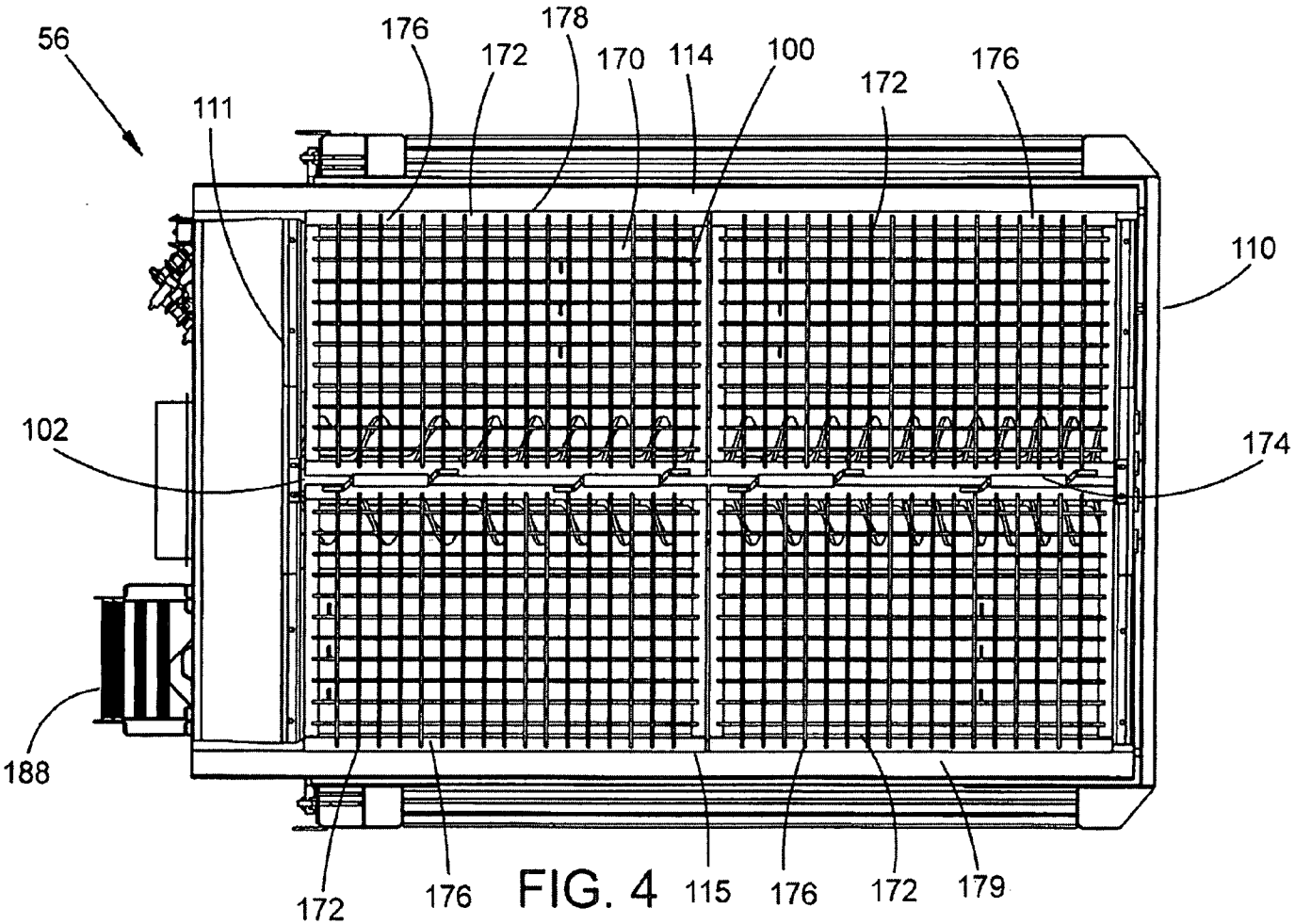
FIG. 4 is a top plan view of the storage and dispensing apparatus and the body of FIG. 1.

Referring to FIG. 11, the hopper 100 includes a top opening 170 for receiving material. Referring to FIG. 4, a plurality of grate screens 172 can be provided to cover the opening 170 of the hopper 100. The grate screens 172 are pivotally mounted to a central ridge 174 extending between the front and rear ends 110, 111. The central ridge 174 can be in the form of an I-beam, as shown in FIG. 14, or a rectangular tube, for example. Referring to FIG. 4, an outer edge 176 of each screen rests on a one of a pair of ledges 178, 179 of the first and second side walls 114, 115 of the storage and dispensing apparatus 56. To open the screens 172, the screens can be pivoted about the central ridge 174 such that the outer edge of the screen engages the ledge of the opposing side wall.

The grate screens 172 can act to prevent larger chunks of material from entering the hopper 100. In the winter, for example, granular material is often stored in a large stockpile before being loaded onto a vehicle. The granular material can freeze and form larger chunks of material. The larger chunks can hinder the flow of material being dispensed from the vehicle for treatment of a roadway, for example. With the screens covering the top opening of the hopper, an operator can load the hopper by depositing granular material onto the grates. Larger chunks tend to roll off the body and can be broken up for subsequent use.

The grates 172 also provide a safety feature in providing a barrier between the outside of the hopper and the conveyor assembly 102 found therein. In some embodiments, the grate screens can be interconnected to the hydraulic system with an interlock system such that the screens cannot be opened until the hydraulic system is disconnected. The interlock system can be one such as is shown and described in U.S. Pat. No. 6,123,276, issued to Ungerer et al. on Sep. 26, 2000.

A ladder 188 is provided to facilitate access to the top opening of the hopper. The ladder 188 is shown in FIG. 1 in a storage position. A portion of the ladder 188 can be folded downward to extend the ladder.

Referring to FIGS. 8 and 11, the conveyor assembly 102 can act to selectively dispense materials from the hopper 100. The conveyor assembly 102 can include a pair of augers 200, 201 disposed in substantially parallel, spaced relationship to each other. Each auger 200, 201 includes a first end 210, a second end 211, and a bladed shaft 212 extending therebetween. The augers 200, 201 are rotatably mounted to the storage and dispensing apparatus 56. The illustrative augers have a diameter of about seven inches. The illustrative dual auger arrangement has an effective width of at least fourteen inches. In other embodiments, the size of the augers can vary. The augers 200, 201 can be disposed apart from each a distance within a predetermined range such that the tendency for granular materials to bridge over the augers or for the augers to tunnel in the granular material is reduced.

Figure 12:
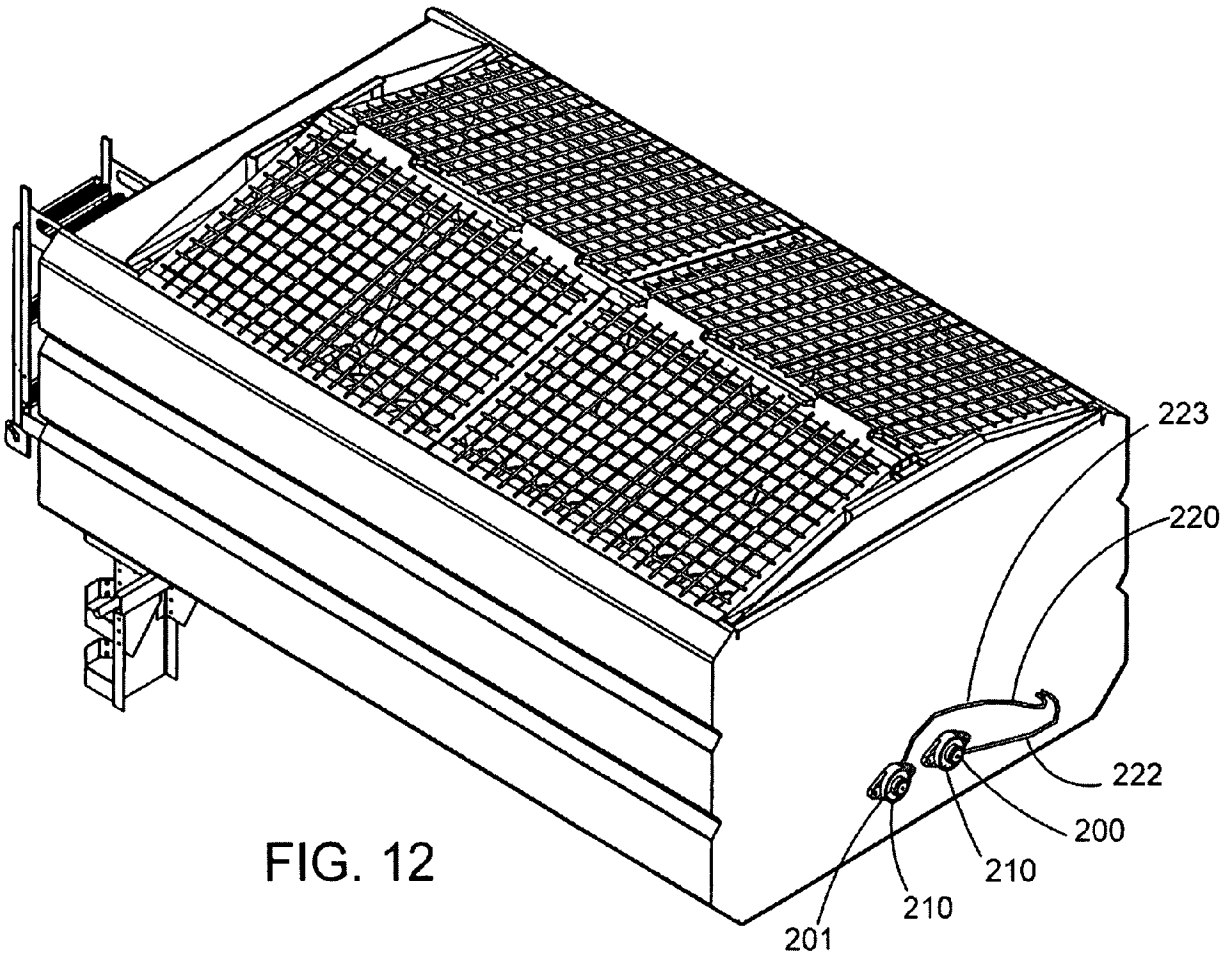
FIG. 12 is a second perspective view of the storage and dispensing apparatus of FIG. 6.
Figure 13:
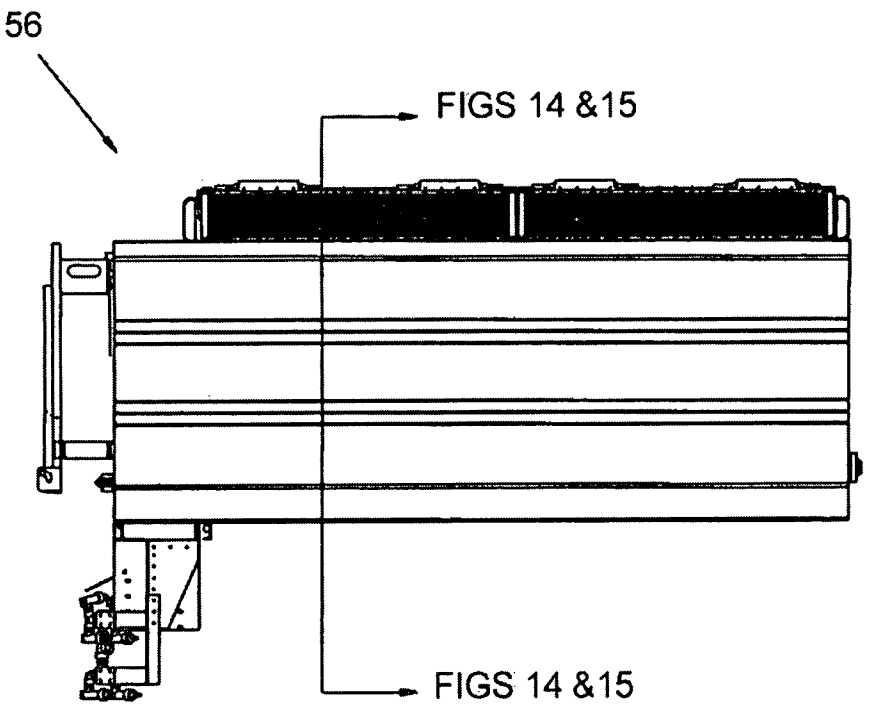
FIG. 13 is a side elevational view of the storage and dispensing apparatus of FIG. 6.

The first ends 210 of the augers 200, 201 are mounted to the front end 110 of the storage and dispensing apparatus by a pair of bearing supports 214 each in the form of a flange-mount bearing. A stub shaft 216 at the first end of each auger extends through the bearing 214 to support the first end 210 of the respective auger 200, 201. Referring to FIG. 12, a lubrication system 220 can be provided which includes a pair of lines 222, 223 which extend from the first ends 210 of the augers 200, 201 for lubricating the bearing supports of the first ends of the augers.

Referring to FIGS. 2 and 8, the second ends 211 of the augers 200, 201 are mounted to a pair of mounting plates 230, respectively. A pair of motors 232 is provided to rotate the augers. The auger motors 232 are mounted to the mounting plates 230. The mounting plates 230 can each cover a hole configured to allow the respective auger 200, 201 to be inserted therethrough for mounting the augers 200, 201 to the storage and dispensing apparatus. Each motor can act as a support bearing for its respective auger at the second end 211.

Referring to FIG. 8, operation of the motors 232 can convey material stored in the hopper 100 in a conveying direction 240 toward the second end 211 of the augers. The second ends 211 of the augers are operably arranged with a discharge chute 250. A portion 244 of the augers 200, 201 extends beyond the rear end 111 toward the cabinet wall 120. Material can be conveyed from the hopper 100 in the conveying direction 240 to the discharge chute 250, which is disposed below the augers 200, 201. The material falls from the augers into the discharge chute 250.

In other embodiments, the conveyor assembly can include an endless chain conveyor, a single auger, three or more augers, one or more belt conveyors, etc. In yet other embodiments, the conveyor assembly can be configured to convey material in the hopper in a conveying direction toward the front end of the hopper to selectively dispense material from the front end of the hopper. The front-discharging conveyor assembly can be useful for dispensing granular material and/or pre-wetted granular material in front of the drive wheels of the chassis to improve the traction of the vehicle and to reduce the spraying of these materials on other vehicles on the roadway being treated.

Figure 10:
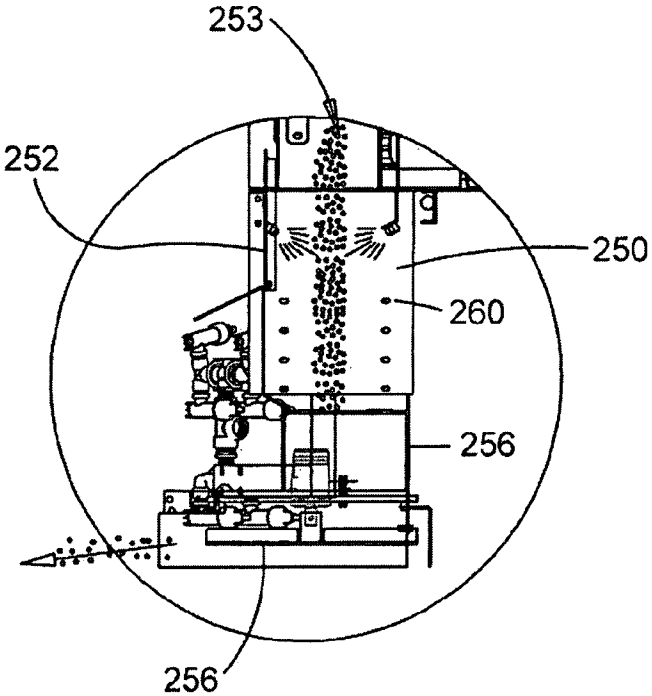
FIG. 10 is a view similar to FIG. 9 illustrating a pivotable baffle in an open position for dispensing granular material.
Figure 9:
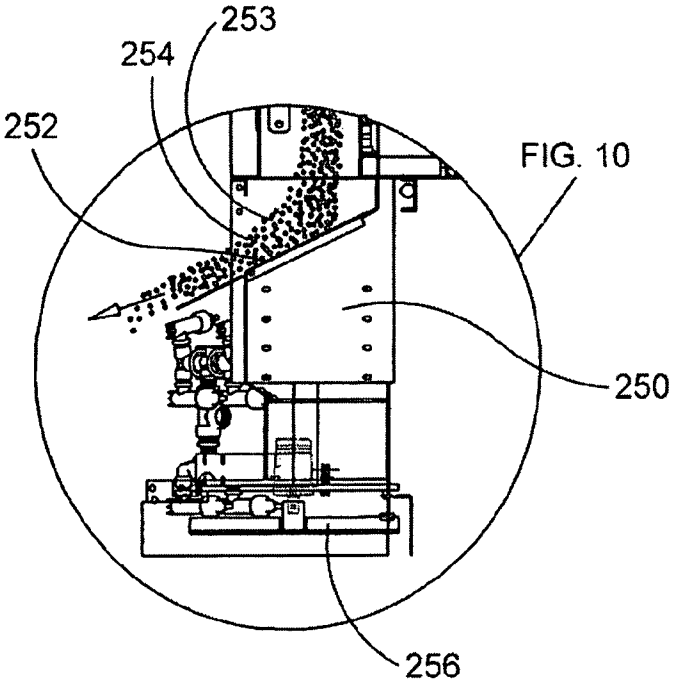
FIG. 9 is an enlarged, detail view taken from FIG. 8.

Referring to FIG. 9, the discharge chute 250 includes a pivotable baffle 252. The baffle 252 can be pivoted between a closed position, as shown in FIG. 9, and an open position, as shown in FIG. 10. In the closed position, the baffle 252 can divert material 253 through a bypass chute 254. Putting the baffle 252 in the closed position allows an operator to rapidly discharge the contents of the hopper 100 out through the bypass chute 254. Referring to FIG. 10, the baffle 252 can be substantially vertical when in the open position. In the open position, the baffle 252 allows material 253 to pass to a spreader or spinner disc 256 for selective spreading.

A lower portion 258 of the discharge chute 250 can be mounted at a selected one of four sets of mounting holes 260 for telescope adjustment thereof.

Figure 7:
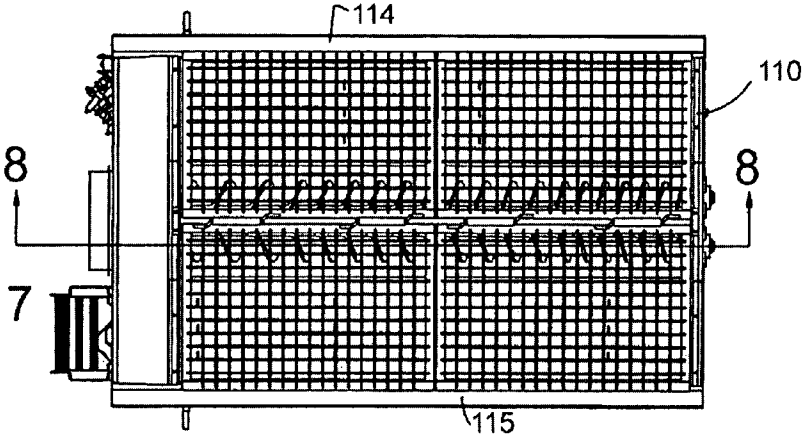
FIG. 7 is a top plan view of the storage and dispensing apparatus of FIG. 6.
Figure 15:
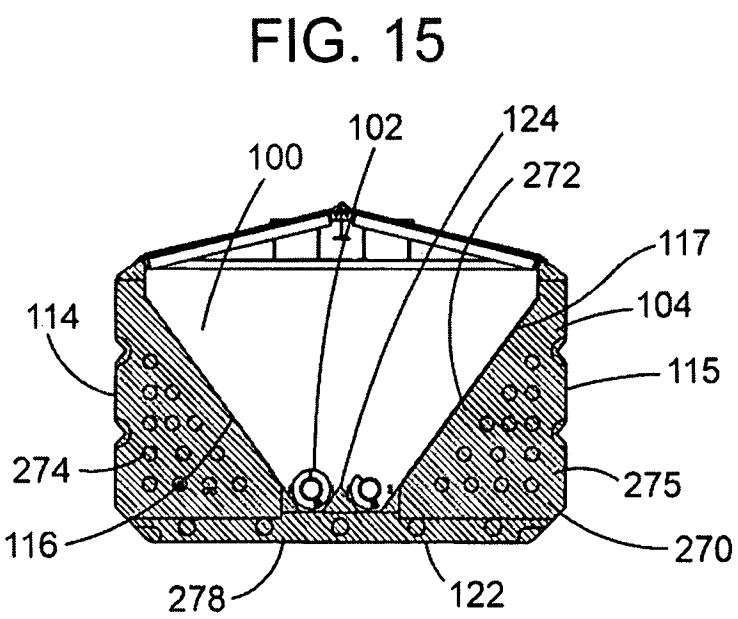
FIG. 15 is a view similar to FIG. 14, illustrating a liquid containment vessel in highlighted cross-hatching.

Referring to FIGS. 7 and 15, the liquid storage system 104 is provided for storing liquid, such as anti-icing liquid, for example. The front and rear ends 110, 111, the first and second side walls 114, 115, the first and second common walls 116, 117, the bottom 122, and the intermediate base 124 define a liquid containment vessel 270. The liquid containment vessel 270 is shown in cross-hatching 272 in FIG. 15.

The liquid containment vessel 270 includes a pair of side sections 274, 275, which flank the hopper 100, and an intermediate connecting section 278, which extends between the side sections 274, 275 below the hopper 100 and the conveyor assembly 102. A sump area can be fluidly connected to the connecting section of the liquid containment vessel. The liquid containment vessel 270 is a unitized structure which allows the side sections 274, 275 and the connecting section 278 to be fluidly connected to each other.

Figure 22:
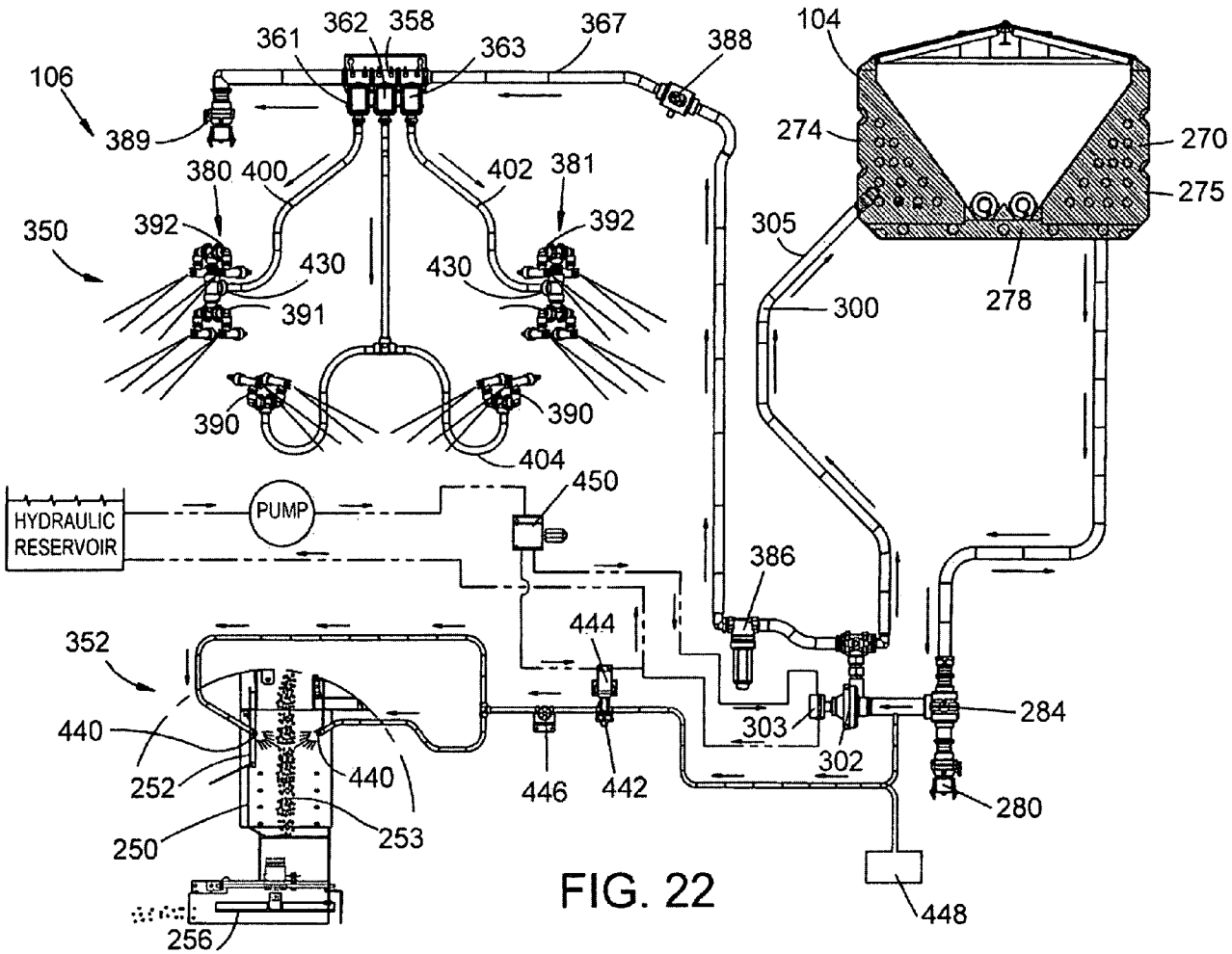
FIG. 22 is a generally schematic view of a liquid dispensing system and a liquid storage system of the storage and dispensing apparatus of FIG. 6.

Referring to FIG. 6, the liquid containment vessel includes a fill port 280 for filling the liquid containment vessel. The fill port 280 includes a removable cover 282 that can seal the fill port to prevent leakage therefrom. Referring to FIG. 22, a valve 284 can be connected to the fill port 280 to allow liquid to flow into the containment vessel 270. Liquid entering the containment vessel 270 can flow between the side sections 274, 275 via the connecting section 278 and seek an equilibrium level.

Figure 16:
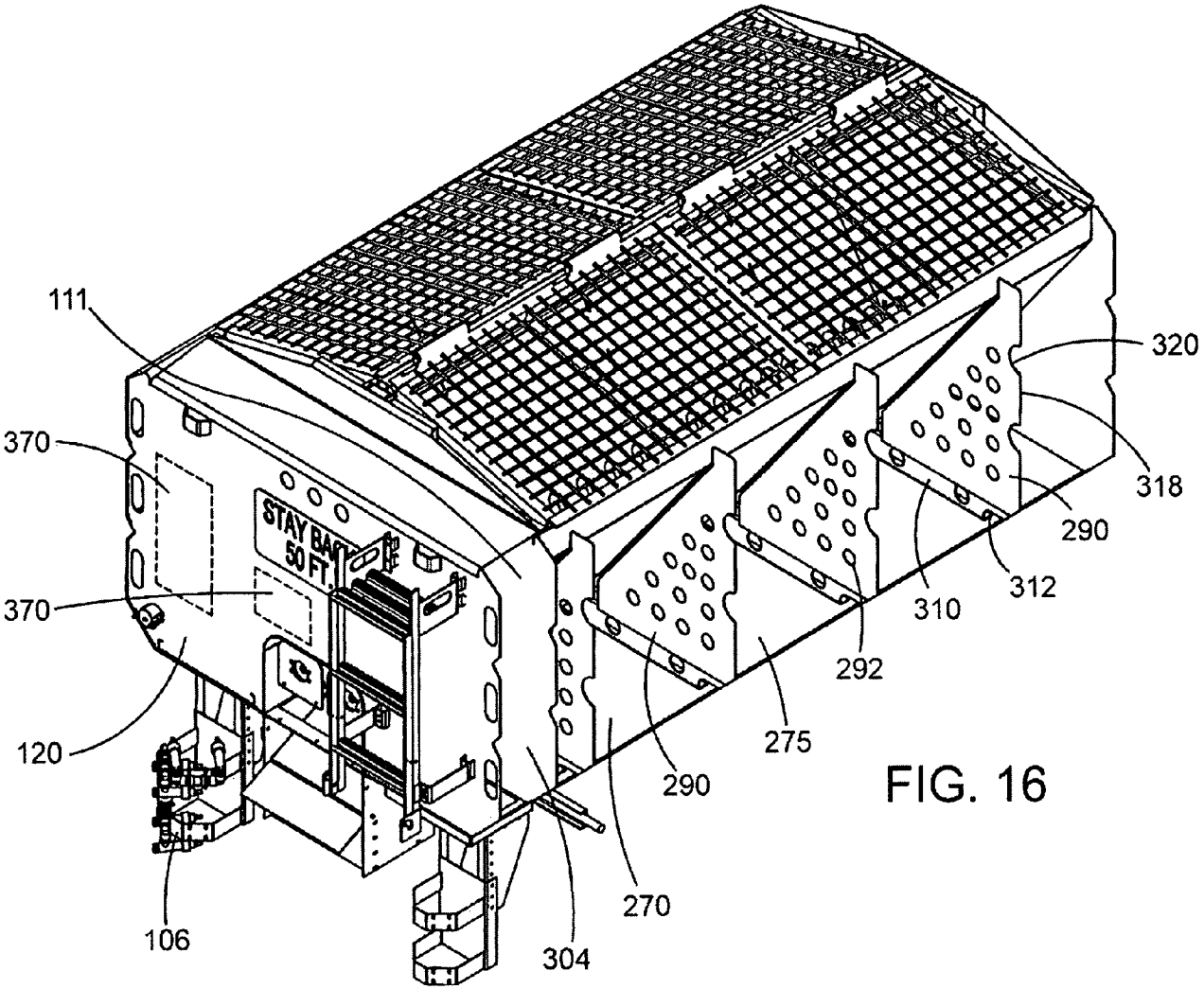
FIG. 16 is a partially broken away, perspective view of the storage and dispensing apparatus of FIG. 6, illustrating a liquid containment vessel.
Figures 17, 18:
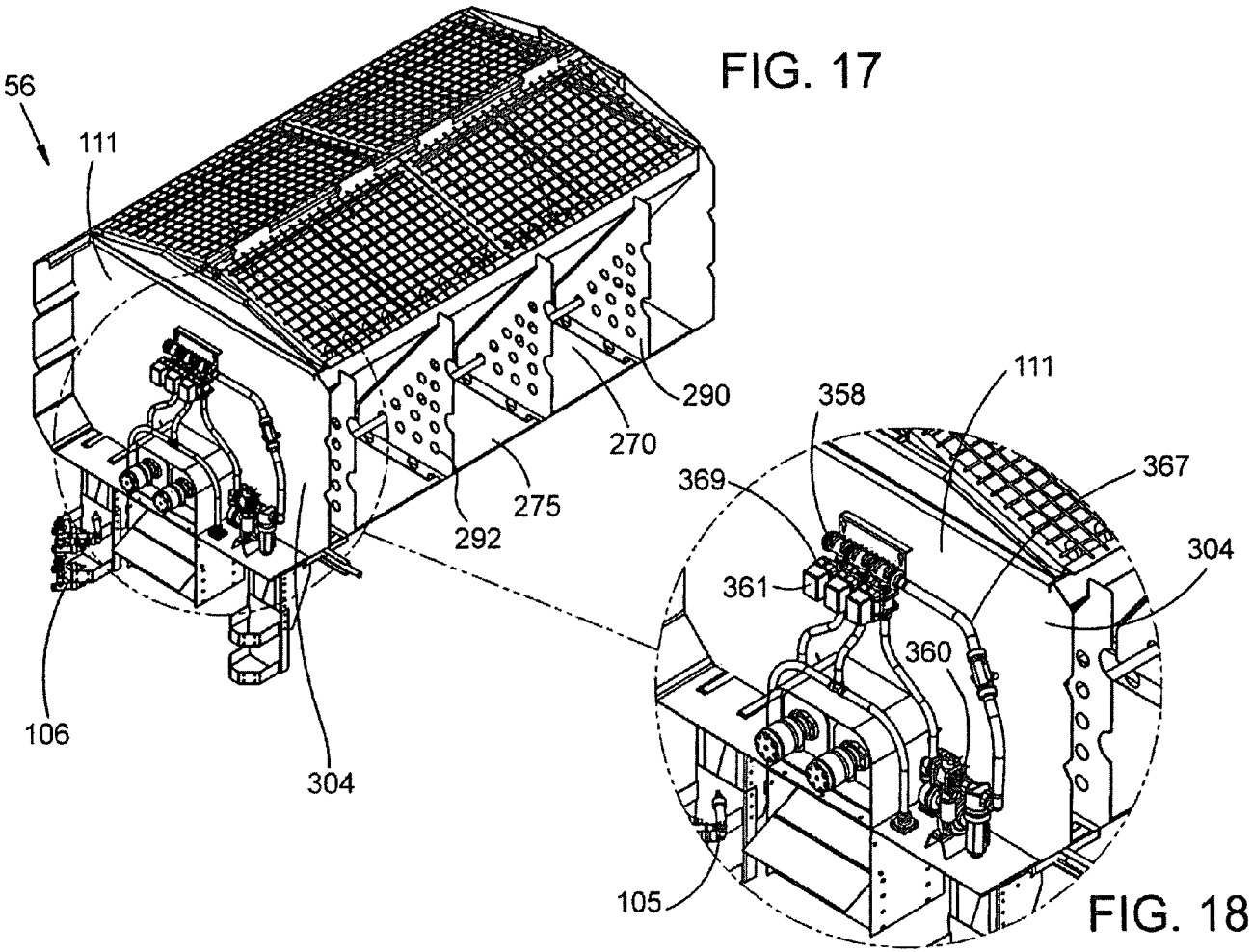
FIG. 17 is a second partially broken away, perspective view of the storage and dispensing apparatus of FIG. 6, illustrating pre-wet and anti-icing systems disposed within a rear cabinet.
FIG. 18 is an enlarged, detail view taken from FIG. 17.
Figure 19:
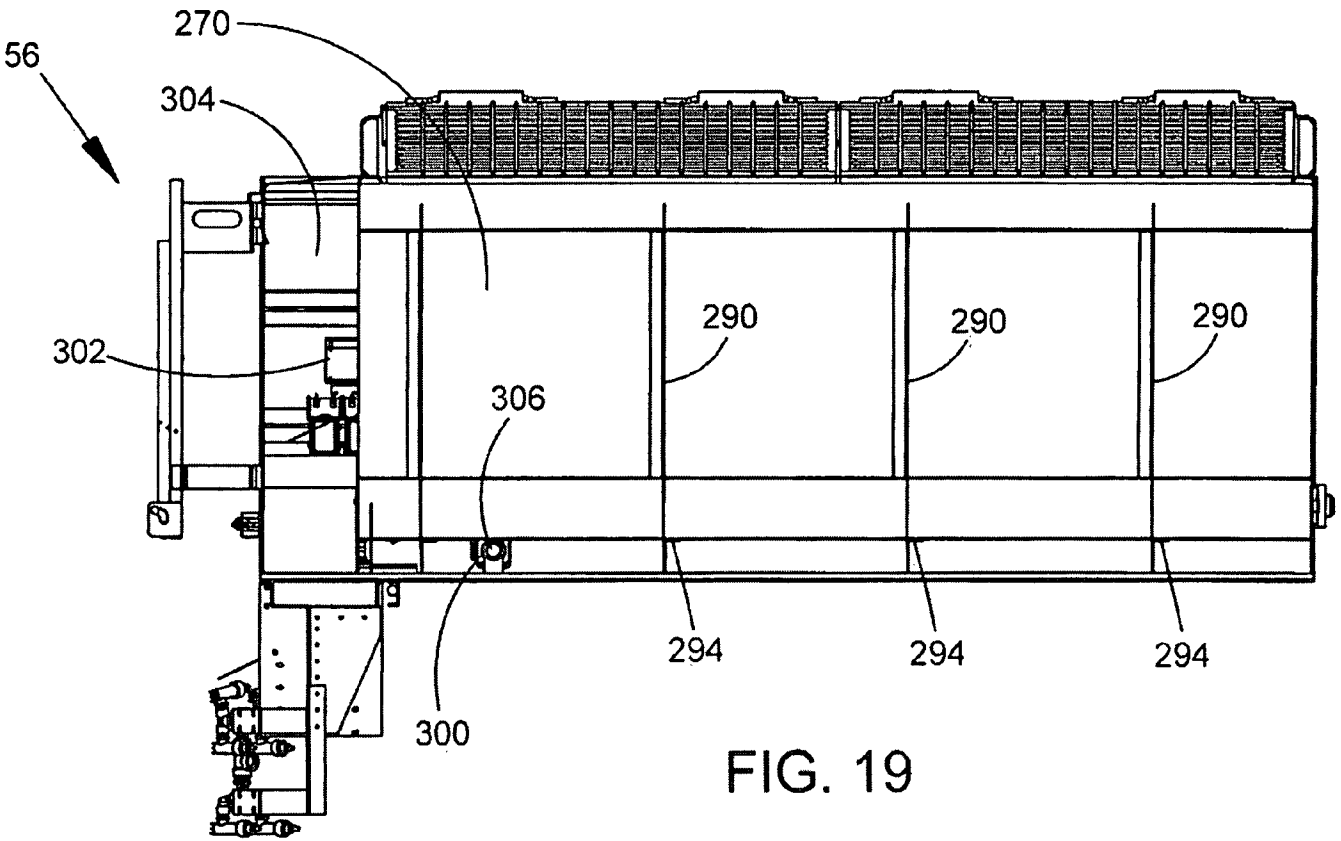
FIG. 19 is a side elevational view, partially broken away, of the storage and dispensing apparatus of FIG. 6, illustrating the liquid containment vessel and a crossover pipe for recirculation of anti-icing liquid within the liquid containment vessel.

Referring to FIGS. 16 and 17, each side section includes a plurality of braces 290 having a series of holes 292 therein. The braces 290 can be provided to inhibit the flow of liquid stored in the liquid containment vessel 270 during acceleration and deceleration of the vehicle. Referring to FIG. 19, the braces 290 can be associated with a mounting flange 294 for securing the braces to the bottom.

Referring to FIGS. 19 and 22, an agitation system 300 is provided to maintain any solids in the liquid stored in the liquid containment vessel 270 in suspension. The agitation system 300 can include a pump 302, operable by a suitable hydraulic motor 303, for example, housed in a plumbing cabinet 304 and suitable piping 305. A portion of pipe 306 that is disposed in the storage and dispensing apparatus 56 and extends across the width of the unit extending between the first and second side sections of the containment vessel can include a plurality of holes in it, which open toward the bottom of the unit.

The pump 302 can operate to circulate the fluid stored in the containment vessel 270 to maintain the solids in suspension. Liquid can be drawn from the containment vessel to the pump from one or more locations. The liquid can be pumped to the liquid containment vessel through the piping 305 and discharged through the holes, thereby creating agitation energy and mixing the liquid. The holes of the pipe can be disposed about between the bottom and the side facing the front end of the storage and dispensing apparatus. The agitation system 300 can be operated continuously and independent of the operation of the dispensing system.

Referring to FIGS. 14 and 16, each brace 290 can be associated with a channel 310 that has a pair of cutouts 312 therein. The channel 310 defines the height of the connecting section 278 of the liquid containment section. The channel can be a formed piece of sheet metal which runs the full width of the unit below the hopper. The cutouts 312 can be disposed at the ends of the channel adjacent the side walls 114, 115 of the unit. The cutouts 312 extend to the bottom 122 for facilitating the cleaning of the containment vessel.

Each brace 290 includes a side edge 318 that has a plurality of recesses 320 which correspond to the V-crimps on the side wall that the brace is adjacent. The recesses are arranged to provide clearance, respectively, for the V-crimps.

The liquid containment vessel can include a clean-out passage at both sides of the rear end of the unit to aid in the cleaning or draining of the interior thereof.

Figure 3:
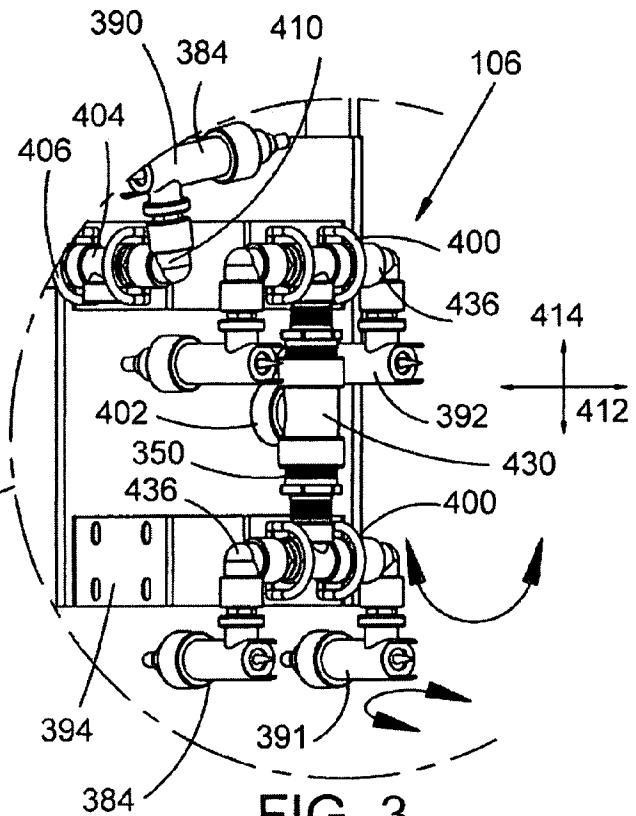
FIG. 3 is an enlarged, detail view taken from FIG. 2.

Referring to FIGS. 2, and 3, and 22, a liquid dispensing system 106 for selectively dispensing liquid from the liquid storage system 104 can be provided. The liquid dispensing system 106 can selectively dispense liquid from the liquid containment vessel. The liquid dispensing system 106 includes an anti-icing system 350 for selectively dispensing liquid from the vehicle and a pre-wetting system 352 for selectively dispensing liquid onto material being transported by the conveyor assembly 102 out of the unit.

Referring to FIGS. 16-18, the plumbing cabinet 304 is defined by the cabinet wall 120 and the rear end 111 of the storage and dispensing apparatus 56. The plumbing cabinet 304 can house a manifold assembly 358 and a plurality of pumps 302, control valves 361, lines 367, electronic devices 369, and other equipment associated with operating the anti-icing system and pre-wetting system of the dispensing system. The liquid dispensing system 106 can be mounted within the plumbing cabinet 304 with at least a portion thereof extending rearwardly from the cabinet wall of the unit. The cabinet wall 120 can include one or more access panels 370, shown in phantom lines in FIG. 16, for readily accessing the hydraulic components, valves, pumps, motors. etc. housed in the plumbing cabinet 304.

In other embodiments, the cabinet for containing the plumbing parts can be located in other locations, such as, at the front of the unit or on top of, in front of, or on the truck frame sides, for example.

Referring to FIG. 2, the anti-icing system 350 of the liquid dispensing system 106 includes a plurality of liquid dispensing elements. In the embodiment shown in FIG. 2, the illustrative anti-icing system 350 of the liquid dispensing system 106 includes a first and a second nozzle assembly 380, 381. Each nozzle assembly 380, 381 is a multi-tiered assembly including a plurality of pairs of spray nozzles 384. Each, spray nozzle 384 is fluidly connected to the liquid storage system via the lines, motors, pumps, etc. housed in the plumbing cabinet. The anti-icing system 350 can include the anti-icing pump 302, which is operated by the hydraulic motor 303, a filter 386, and an anti-icing liquid flow meter 388. The first and second nozzle assemblies 380, 381 can be fluidly connected to the liquid storage system 104 via the manifold assembly 358 and appropriate piping. A supplemental port 389 can be provided to allow for rapid emptying of the liquid containment vessel 270, additional spray nozzles, or other auxiliary uses.

Each nozzle 384 can be a variable displacement orifice nozzle. The flow of liquid from the anti-icing nozzles can be varied by changing the size of the orifice of each nozzle. Each anti-icing nozzle can be selectively pivotable along at least two perpendicular axes. The nozzle assemblies 380, 381 can be operable to control the flow of liquid from the liquid storage system 104 to the anti-icing system 350 and to direct the dispensing of the liquid from the liquid storage system.

Each illustrative nozzle assembly 380, 381 includes six nozzles grouped together in three gangs of two. Each nozzle assembly includes an upper pair 390, a lower pair 391, and an intermediate pair 392 disposed between the upper and lower pairs 390, 391. Referring to FIG. 1, each nozzle assembly includes a two-tiered mounting bracket 394 for supporting the nozzles and the plumbing lines and connectors associated therewith. Each bracket 394 includes a plurality of mounting holes 396 for receiving fasteners, U-bolts, for example, for mounting the nozzles and the plumbing.

Referring to FIGS. 2 and 22, each nozzle assembly 380, 381 is fluidly connected to the liquid storage system 104 via one or more anti-icing lines 400, 401, 402. The anti-icing lines 400, 401, 402 can be connected to the manifold assembly 358 for selectively controlling the flow of liquid to the anti-icing system 350.

An upper nozzle supply line 404 can branch from one of the anti-icing lines 401 to fluidly connect both upper pairs 390 of the nozzle assemblies 380, 381 to the manifold assembly 358. A pair of U-bolts 406, for example, can mount the upper nozzle supply line 404 to each mounting bracket. The nozzles of each upper pair 390 each include an elbow 410 that extends from the upper nozzle supply line 404. The nozzles 384 of the upper pairs 390 extend from their respective elbows 410. Each elbow is a 90°-style. Each elbow is rotatably mounted to the supply pipe about a first axis 412, as shown in FIG. 3. Each nozzle 384, in turn, is rotatably mounted to the elbow 410 from which it extends about a second axis 414, which can be perpendicular to the first axis 412. The first and second axes 412, 414 are substantially horizontal and vertical, respectively.

The intermediate and the lower pairs 392, 391 of nozzles from each nozzle assembly 380, 381 can be fluidly connected to the liquid storage system 104 via the main anti-icing lines 400, 402, respectively, through the manifold assembly 358 for selectively controlling the flow of liquid to the intermediate and lower pairs 392, 391 of nozzles.

Referring to FIGS. 3 and 22, the intermediate and the lower pairs 392, 391 of each nozzle assembly extend from the main anti-icing lines 400, 402. U-bolts 400, for example, can mount the piping of the intermediate and lower pairs 392, 391 of nozzles to the mounting bracket 394. The intermediate and lower pairs 392, 391 of nozzles are fluidly connected to the main anti-icing line 400, 402, respectively, by a branch line 430.

The intermediate and lower pairs 392, 391 of nozzles are rotatably mounted to the branch line 430. The nozzles 384 of each intermediate and lower pair each include an elbow 436 that extends from the branch line 430. The nozzles extend from their respective elbows. Each elbow is a 90°-style. Each elbow 436 is rotatably mounted to the respective branch line 430 about the first axis 412. Each nozzle 384, in turn, is rotatably mounted to the elbow 436 from which it extends about the second axis 414.

Referring to FIG. 22, a control valve can be associated with each set of nozzles to provide independent selective operation of each set of nozzles. In this embodiment, three control valves 361, 362, 363 can be provided. One control valve 362 can be arranged with the upper pairs 390 of nozzles of the first and second nozzle assemblies 380, 381. A second valve 361 can be associated with the intermediate and lower pairs 392, 391 of nozzles of the first nozzle assembly 380. A third valve 363 can be associated with the intermediate and lower pairs 392, 391 of nozzles of the second nozzle assembly 381.

The volume of liquid being dispensed by each nozzle can be selectively adjusted. The volume of liquid being dispensed can be correlated to the vehicle ground speed to apply a predetermined amount of liquid per mile, for example 15 gallons per lane mile traveled by the vehicle. The nozzle orifice can be spring-loaded so that as system pressure rises, the orifice enlarges to provide an increased opening area, thereby allowing for a wider range of liquid flow at a narrower supply pressure. The nozzles can be operated between about 1.0 psi and about 100 psi, for example, and preferably between about 20 psi and about 30 psi. The nozzle sets can be adjusted to dispense liquid anywhere up to about 50 gallons per lane mile, for example, and preferably between about 10 gallons per lane mile and about 25 gallons per lane mile.

The six pairs of anti-icing nozzles can be selectively adjusted to direct the application of anti-icing liquid onto a surface, such as a roadway, for example. Each anti-icing nozzle can be independently adjusted. The six pairs of anti-icing nozzles can be adjusted to cover three 12-foot lanes of road, for example. The anti-icing nozzles can be adjusted about the first and second axes to direct the anti-icing liquid onto the lanes of the road. The speed of the vehicle and the lane in which the vehicle is driving can affect the spray pattern of anti-icing liquid from the anti-icing nozzles. The nozzles can be adjusted to compensate for such parameters to accurately apply anti-icing liquid onto the roadway. The anti-icing nozzles can be directed to discharge anti-icing liquid directly behind the vehicle and/or to the sides of the vehicle. The spray width of the anti-icing nozzles can be adjusted to meet varying road conditions.

For example, the upper pairs 390 of the first and second nozzle assemblies 380, 381 can be directed toward each other such that the upper pairs 390 dispense anti-icing liquid substantially directly behind the vehicle, i.e., the lane in which the vehicle is positioned. The intermediate and lower pairs 392, 391 of the first nozzle assembly 380 can be adjusted such that they dispense anti-icing liquid to the left side of the vehicle, i.e., in the lane to the left of the lane in which the vehicle is positioned. The intermediate and the lower pairs 392, 391 of nozzles of the second nozzle assembly 381 can be adjusted such that they dispense anti-icing liquid to the right side of the vehicle, i.e., in the lane to the right of the lane in which the vehicle is positioned.

Referring to FIGS. 10 and 22, the pre-wetting system 352 can include a plurality of spray nozzles 440, a pre-wet liquid pump 442, which is driven by a pre-wet hydraulic motor 444, for example, and a pre-wet flow meter 446. Each spray nozzle 440 is fluidly connected to the liquid storage system 104 via appropriate piping. The nozzles 440 can be operable to control the flow of liquid from the liquid storage system. The nozzles 440 of the pre-wetting system 352 can be selectively adjusted to discharge liquid onto granular material 253 dispensed from the conveyor assembly as it moves through the discharge chute 250. Each pre-wet nozzle 440 can be a variable displacement orifice nozzle. The flow of liquid from the pre-wet nozzles 440 can be varied by changing the size of the orifice of each nozzle. The pre-wet spray nozzles 440 can be disposed within the discharge chute 250 such that they can spray granular material 253 as it moves therethrough to the spreader disc 256.

In other embodiments, a separate reservoir 448 can be provided. The pre-wet spray nozzles 440 can be fluidly connected to the reservoir 448 with the pre-wet pump 442 acting to pump pre-wetting liquid from the reservoir 448 out the pre-wet nozzles 440.

The operator can control the flow of liquid from the storage system 104 to provide two functional modes. In the first functional mode, the liquid dispensed from the pre-wet nozzles 440 can serve to "pre-wet" the granular material, such as salt, for example, as the material drops from the conveyor assembly through the discharge chute 250 to the spreader 256. In the second functional mode, liquid can be routed to multiple, variable displacement anti-icing nozzles which can be controlled for directional discharge onto a surface, such as a roadway. The dispensing system can be configured such that the flow of liquid can occur simultaneously in both functional modes to provide for simultaneous pre-wetting and anti-icing operations or such that one of the functional modes is operating and the other mode is idle. A hydraulic control valve 450 can be provided to allow for selective driving of the pre-wet motor 444 and the anti-icing motor 303 to operate the first and second functional modes, respectively.

It will be understood that in other embodiments, the number and arrangement of nozzles of the liquid dispensing system can be varied. In other embodiments, the pre-wet and/or anti-icing nozzles can have a fixed-displacement orifice. In embodiments where the granular material is discharged from the front of the hopper, one or more nozzles or other liquid dispensing elements can be disposed at the front to provide a front anti-icing spray option. In other embodiments, the anti-icing nozzles can be located in other locations, such as, underneath the chassis frame between the front and rear axle, for example.

As the liquid dispensing system 106 dispenses fluid from the containment vessel, the liquid in the vessel seeks a level interface line, adjusting to the new volumetric amount of liquid therein. The side sections and the connecting section of the containment vessel are fluidly connected to each other to help maintain the balance of the vehicle by more evenly distributing the weight associated with the liquid stored in the containment vessel.

In other embodiments, the liquid dispensing system can include other liquid dispensing elements, such as, one or more spray booms or bars and/or one or more hose drops, either in lieu of, or in combination with, nozzles. The spray bar can comprise a pipe with a plurality of holes therein. The hose drop can be a simple hose of a predetermined length such that the end of the hose is near the surface to enhance the delivery of the liquid to the surface.

Figure 21:
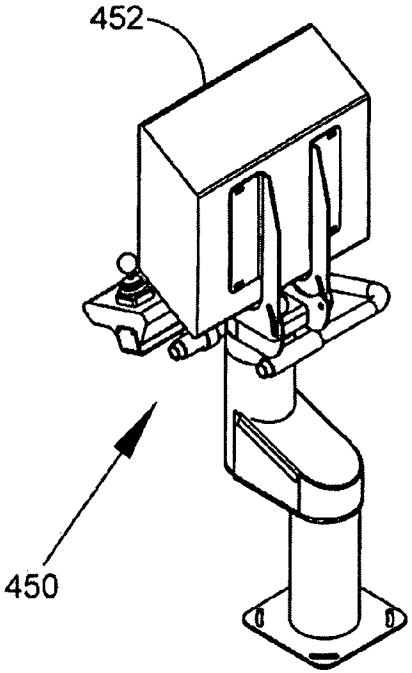
FIG. 21 is a rear perspective view of the control unit of FIG. 19.
Figure 20:
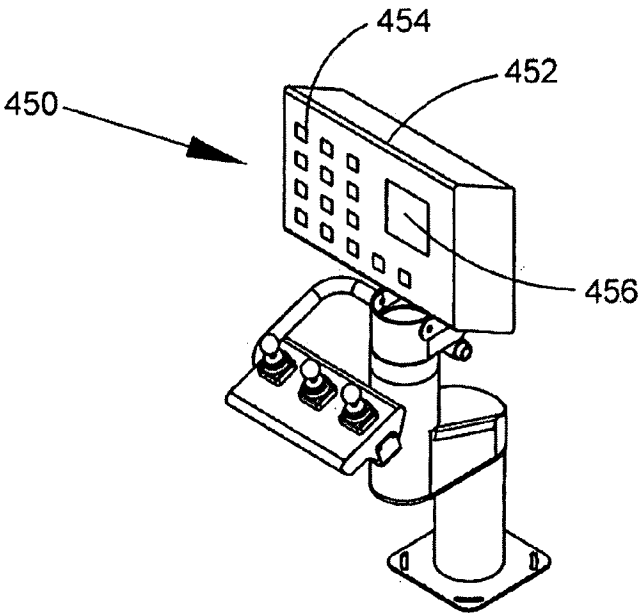
FIG. 20 is a front perspective view of a control unit of a control system useful in connection with the present invention.

Referring to FIGS. 20 and 21, the operation and flow rate of the nozzles of the dispensing system can be monitored and controlled by the truck operator with an electronic control system 450 having a panel 452 disposed in the truck cab. The panel 452 can include a plurality of controls 454 and a display screen 456, such as an LCD. In other embodiments, a second LCD can be remotely connected to the panel and mounted in the cab to provide other operational performance data.

The control system 450 can permit very specific control of application rates of liquid, granular materials, or a combination thereof (3 in 1 control) based on many variables. The variables include air and road surface temperatures, rate and form of precipitation, the number of lanes to be treated, speed of the truck, dispensing rate and spray pattern of the liquid, the volume and spread pattern of the granular materials, and direction and velocity of the material, for example. The nozzles can be independently controlled with a corresponding plurality of valves which control the opening and closing of each nozzle based upon one or more selected parameters, such as ground speed, for instance.

The electronic control system 450 can be used to control the dispensing of liquid and/or material such that the liquid and/or material is dispensed in a rearward direction at substantially the same speed as the vehicle is traveling in a forward direction such that the relative velocity between the liquid and/or material and the ground surface is substantially equal to zero to improve the accuracy of the placement of the liquid upon the surface. The zero velocity feature can operate to reduce the amount of splashing and/or bouncing (or other displacement) the discharged substance undergoes after contacting the surface being treated.

The storage and dispensing apparatus can be used to accurately place materials on the surface being treated, for example, the surface on a curved exit ramp. Because in such a situation the road usually is banked inwardly, it is often desired to dispense the material on the upper shoulder as gravity and the traffic flow will tend to work the material down across the road. The storage and dispensing apparatus allows for the operator to direct material to a predetermined location. The electronic control system 450 can include an automated system which can be tied to a global positioning system (GPS), for example, useful to adjust the flow direction and/or rate of granular material and/or fluid based on the position of the vehicle detected by the GPS. The electronic control system can also be adapted to sense the tilt of the road and adjust the location of material dispensing according to a predetermined response to further enhance the precision placement capabilities of the storage and dispensing apparatus.

Figure 23:
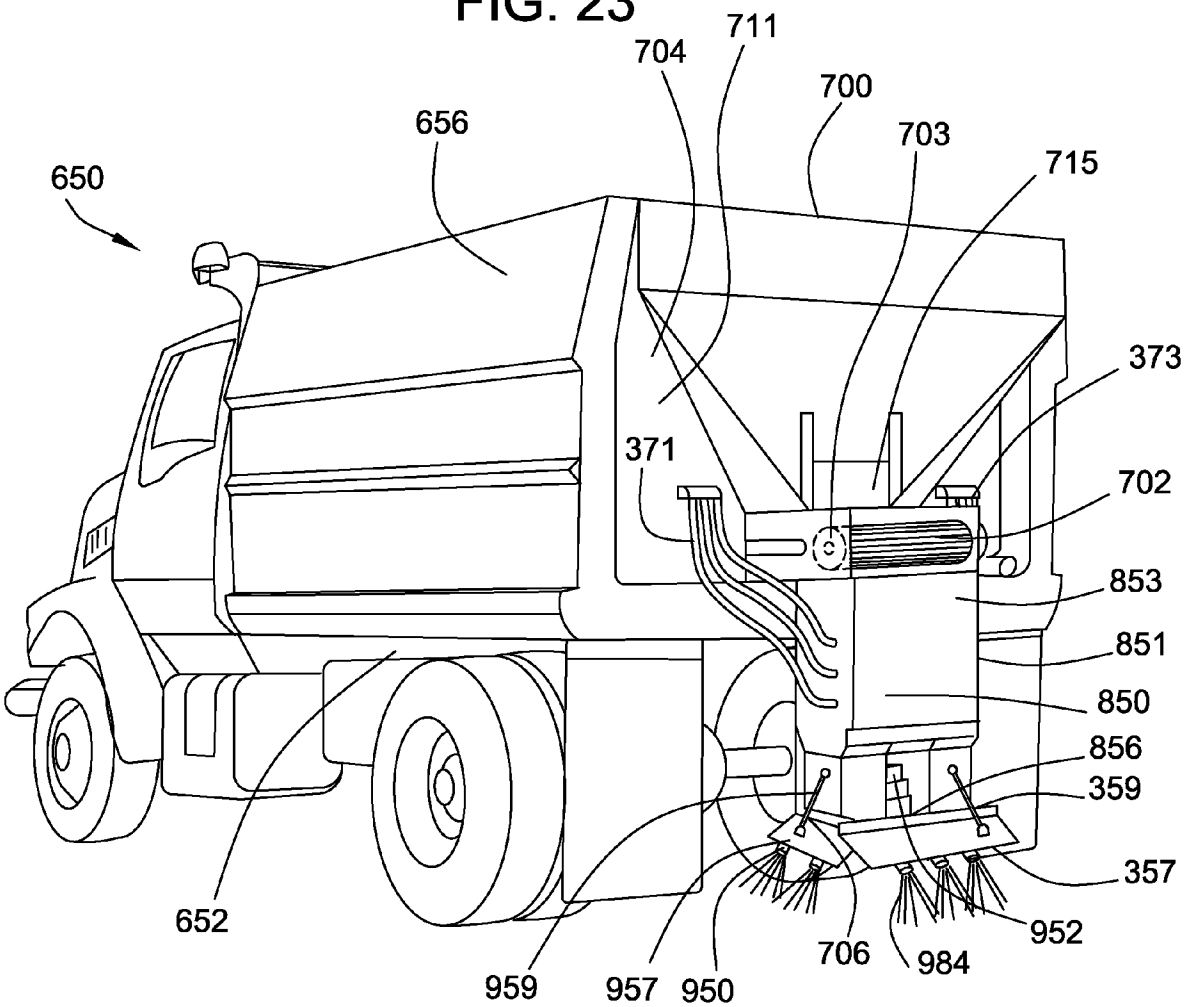
FIG. 23 is a perspective view of another embodiment of a vehicle including a chassis and a storage and dispensing apparatus mounted thereto in accordance with the present invention.

Referring to FIG. 23, another embodiment of a vehicle 650 in accordance with the present invention is shown. The vehicle in FIG. 23 is a chassis-mount version. The vehicle 650 includes a chassis 652 and a storage and dispensing apparatus 656 mounted to the chassis. In other embodiments, the storage and dispensing apparatus 656 can be pivotally mounted to the chassis with a hoist arranged with the storage and dispensing apparatus for selective pivotal movement thereof.

The storage and dispensing apparatus 656 includes a hopper 700 for storing material, such as, a granular ice control material, for example, a conveyor assembly 702 for selectively transporting material from the hopper 700, a liquid storage system 704 for storing liquid, such as, an anti-icing liquid, for example, and a liquid dispensing system 706 for selectively dispensing liquid from the liquid storage system.

The conveyor assembly 702 can include an endless chain conveyor 703 disposed in the material hopper 700 and extending along the length of the storage and dispensing apparatus beyond the rear end 711 thereof. The rear end has an opening to permit the endless conveyor 703 to transport material therethrough. The illustrative endless conveyor 703 can selectively transport material through the opening of the storage and dispensing apparatus out of the hopper.

The conveyor assembly 702 can be controlled in combination with a feed gate assembly 715, a spreader chute 850, and a spreader 856 to dispense material from the hopper of the storage and dispensing apparatus in a desired spread pattern. The feed gate assembly 715 can be mounted to the rear end of the storage and dispensing apparatus and is provided to selectively cover the opening therein, thereby providing a means for adjustably metering the flow of material through the opening. When spreading is desired, the opening can be selectively opened or closed by operation of the feed gate assembly 715. The conveyor assembly 702 can transport material residing within the hopper 700 out of the storage and dispensing apparatus, through the opening, thereby resulting in a deposit of the material through the chute 850 and into the spreader 856.

The spreader chute 850 is operably arranged with the conveyor assembly 702 to receive material therefrom and to direct the material to the spreader 856. The chute 850 is mounted to the rear end of the storage and dispensing apparatus. The spreader chute 850 includes a body 851 which defines a passageway 853. The chute 850 is configured to direct material from the endless conveyor 702 through the passageway 853.

The spreader disc 856 is provided to selectively spread material onto a surface, such as a roadway, for example. The spreader disc 856 can be adjustable to vary the resulting spread pattern of material. The spreader 856 is mounted to the spreader chute 850. The spreader disc 856 is cooperatively arranged with the spreader chute 850 to selectively receive materials directed through the passageway 853 of the chute from the conveyor assembly.

The liquid storage system 704 of the vehicle of FIG. 23 can be similar in construction and operation to the liquid storage system 104 of the vehicle shown in FIG. 1.

The liquid dispensing system 706 can be provided to selectively dispense liquid from the liquid storage system 704. The liquid dispensing system 706 includes an anti-icing system 950 for selectively dispensing liquid from the liquid storage system and a pre-wetting system 952 for selectively dispensing liquid onto material being transported by the endless conveyor 702 out of the hopper 700.

The liquid dispensing system 706 includes first and second manifolds 371, 373, each having a plurality of first and second lines fluidly connected thereto. The manifolds 371, 373 are fluidly connected to both the anti-icing system 950 and the pre-wetting system 952. The manifolds 371, 373 are operable to control the flow of liquid from the liquid storage system 704 to the anti-icing system 950 and to the pre-wetting system 952.

The pre-wetting system 952 includes a plurality of variable displacement nozzles which are fluidly connected to the manifolds 371, 373 via the first lines. The pre-wet nozzles are disposed within the spreader chute 850.

The anti-icing system 950 includes a plurality of variable displacement nozzles 984 which are fluidly connected to the manifolds 371, 373 via the second lines. The variable displacement nozzles 984 are selectively movable. The anti-icing system 950 includes a plurality of deflector plates 957 for selectively moving the variable displacement nozzles 984. The deflector plates 957 are pivotally mounted to the spreader chute 850. A plurality of deflector plate actuators 959 are connected between the deflector plates 957 and the spreader chute 850 for selective rotational movement of the deflector plates 957. The deflector plates 957 depend from the spreader chute 850, and the variable displacement nozzles 984 in turn depend from the deflector plates 957.

The manifolds 371, 373 can control the flow of liquid from the liquid storage system to provide two functional modes. The manifolds 371, 373 can selectively dispense liquid, anti-icing fluid, for example, to the injection nozzles located inside the spreader chute 850 for pre-wetting the material being dispensed by the conveyor assembly 702 from the hopper 700 and to the variable displacement spray nozzles 984 for application onto a surface, such as a roadway. In the first functional mode, liquid is routed to one or more nozzles inside the chute 850. The liquid dispensed from the nozzles, can serve to "pre-wet" the de-icing granular material, such as salt, for example, as the material drops to the spreader 856 disposed at the bottom of the chute 950. In the second functional mode, liquid is routed to multiple, variable displacement nozzles 984 which exhaust below the spreader 856. These nozzles 984 can be controlled for directional discharge by their attachment to the deflector plates 957. The manifolds 371, 373 can be configured such that the flow of liquid can occur simultaneously in both functional modes to provide for simultaneous pre-wetting and anti-icing operations.

The vehicle 650 shown in FIG. 23 can be similar in other respects to the vehicle 50 shown in FIG. 1.

Figure 24:
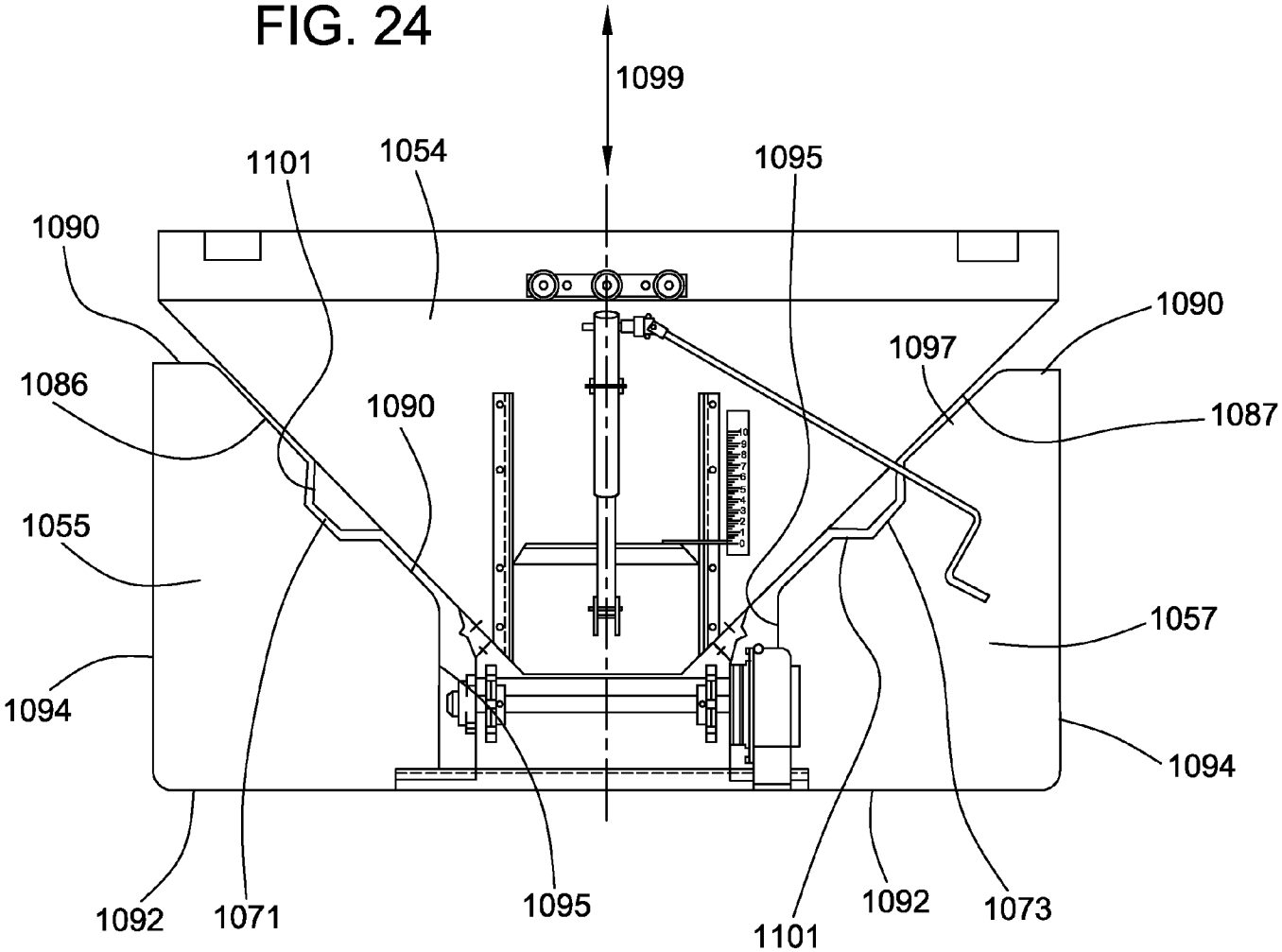
FIG. 24 is an end elevational view of another embodiment of a body having a liquid storage system in accordance with the present invention.

Referring to FIG. 24, another embodiment of a body 1052 and a pair of liquid storage tanks 1055, 1057 is shown. The body 1052 includes first and second side walls 1086, 1087. The body 1052 includes first and second horizontal side braces 1071, 1073 extending respectively from the first and second side walls 1086, 1087 along the substantially the entire length of the body 1052 for stiffening the side walls.

Each storage tank 1055, 1057 includes a top wall 1090, a bottom wall 1092, first and second side walls 1094, 1095, and an inclined wall 1097. The illustrative tanks are configured to fit within the footprint of the body 1052, flanking the side walls 1086, 1087 of the body 1052. The inclined walls 1097 of the tanks 1055, 1057 substantially conform to the side walls 1086, 1087, respectively, which are disposed at an angle preferably between about 22° and about 60°, and even more preferably of about 45° with respect to a vertical axis 1099.

Each inclined wall 1097 can includes a groove 1101. The grooves 1101 can accommodate the horizontal braces 1071, 1073 of the body 1052. The first and second horizontal side braces 1071, 1073 allow for a nested arrangement between the storage tanks 1055, 1057 and the body 1052. This nested arrangement can allow for a predetermined volume of anti-icing liquid to be stored according the chassis capabilities, for example, without sacrificing capacity for granular material in the body 1052.

The storage tanks can be connected together by a cross-pipe to fluidly connect the storage tanks together.

In other embodiments, the storage and dispensing apparatus can be mounted to other types of bodies, such as, conventional bodies, including flatbeds, trailers, "hook-lifts." etc., for example, which can have a hoist system. The storage and dispensing apparatus can be mounted via a conventional "hook" system, for example.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A vehicle comprising:

a chassis;

a storage and dispensing apparatus, the storage and dispensing apparatus disposed upon the chassis, the storage and dispensing apparatus including a hopper for storing material, a conveyor assembly for selectively transporting material from the hopper, at least a portion of the conveyor assembly disposed within the hopper, a unitized liquid containment vessel for storing liquid, and a liquid dispensing system for selectively dispensing liquid from the liquid containment vessel;

wherein the storage and dispensing apparatus includes front and rear ends, first and second side walls, first and second common walls, a bottom, and an intermediate base, the front and rear ends, the first and second common wails, and the intermediate base defining the hopper, the front and rear ends, the first and second side walls, the first and second common walls, the bottom, and the intermediate base defining the unitized liquid containment vessel, the liquid containment vessel including first and second side sections disposed between the first side wall and the first common wall and the second side wall and the second common wall, respectively, and a connecting section disposed between the first and second side sections, the connecting section disposed between the bottom and the intermediate base, the first and second side sections and the connecting section being fluidly connected together over a predetermined length extending between the front and rear ends.

2. The vehicle of claim 1 further comprising: a body, the body being mounted to the chassis, the body comprised of front and rear ends, and first and second side walls, the storage and dispensing apparatus being disposed upon the body, the body being disposed between the chassis and the storage and dispensing apparatus.

3. The vehicle of claim 2 wherein the body is pivotally mounted to the chassis.

4. The vehicle of claim 2 wherein the storage and dispensing apparatus is disposed within the first and second side walls of the body.

5. The vehicle of claim 4 wherein the rear end of the storage and dispensing apparatus extends beyond the rear end of the body.

6. The vehicle of claim 1 wherein the conveyor assembly comprises a pair of augers in substantially parallel, spaced relationship to each other.

7. The vehicle of claim 1 wherein the liquid containment vessel includes a plurality of braces disposed within the first and second side sections.

8. The vehicle of claim 7 wherein the braces each include a plurality of holes therein.

9. The vehicle of claim 1 further comprising: an agitation system for mixing liquid stored within the liquid storage system.

10. The vehicle of claim 1 wherein the liquid dispensing system includes a pre-wetting system and an anti-icing system.

11. The vehicle of claim 10 wherein the liquid dispensing system includes a liquid dispensing element.

12. The vehicle of claim 11 wherein the liquid dispensing element comprises a nozzle.

13. The vehicle of claim 10 wherein the liquid dispensing system includes a plurality of liquid dispensing elements which comprise nozzles.

14. The vehicle of claim 10 wherein the hopper includes a discharge chute, and the pre-wetting system includes a liquid dispensing element disposed in the discharge chute.

15. The vehicle of claim 1 further comprising: a control system for controlling the liquid dispensing system.

16. The vehicle of claim 1 wherein the storage and dispensing apparatus includes a clean-out passage which is connected to the liquid storage system.

17. The vehicle of claim 1 wherein the first and second common walls are disposed at about a 45° angle with respect to an axis perpendicular to the intermediate base.

18. The vehicle of claim 1 wherein the first and second common walls are disposed at complementary angles with respect to the intermediate base.

19. A vehicle comprising:

a chassis;

a storage and dispensing apparatus, the storage and dispensing apparatus disposed upon the chassis, the storage and dispensing apparatus including a hopper for storing material, a conveyor assembly for selectively transporting material from the hopper, at least a portion of the conveyor assembly disposed within the hopper, a liquid storage system for storing liquid, and a liquid dispensing system for selectively dispensing liquid from the liquid storage system;

wherein the storage and dispensing apparatus includes front and rear ends, first and second side walls extending between the front and rear ends, first and second common walls disposed inwardly of the first and second side walls, a bottom extending between the first and second side walls, and an intermediate base extending between the first and second side walls and disposed inwardly of the bottom, the front and rear ends, the first and second common walls, and the intermediate base defining the hopper, the front and rear ends, the first and second side walls, the first and second common walls, the bottom, and the intermediate base defining a unitized liquid containment vessel for the liquid storage system, the liquid containment vessel including a pair of side sections flanking the hopper and an intermediate connecting section extending between the side sections and disposed below the hopper and the conveyor assembly, the connecting section extending a predetermined distance between the front and rear ends.

20. The vehicle of claim 19 wherein each side section includes a plurality of braces adapted to inhibit the flow of liquid stored in the liquid containment vessel.

* * * * *